US009527643B2

(12) United States Patent
Streich et al.

(10) Patent No.: US 9,527,643 B2
(45) Date of Patent: Dec. 27, 2016

(54) PACKAGE WITH OPEN CHAMBER

(71) Applicant: TARGET BRANDS, INC., Minneapolis, MN (US)

(72) Inventors: Jacob Streich, St. Louis Park, MN (US); Matthew M. Culver, Golden Valley, MN (US); Wade A. Ledin, St. Paul, MN (US); Thomas G. Hill, St. Michael, MN (US)

(73) Assignee: Target Brands, Inc., Minneapolis, MN (US)

( * ) Notice: Subject to any disclaimer, the term of this patent is extended or adjusted under 35 U.S.C. 154(b) by 149 days.

(21) Appl. No.: 14/602,032

(22) Filed: Jan. 21, 2015

(65) Prior Publication Data

US 2016/0207680 A1 Jul. 21, 2016

(51) Int. Cl.

| | |
|---|---|
| ***B65D 23/12*** | (2006.01) |
| ***B65D 73/00*** | (2006.01) |
| ***B65B 61/20*** | (2006.01) |
| ***B65D 77/26*** | (2006.01) |

(52) U.S. Cl.

CPC ..... *B65D 73/005* (2013.01); *B65B 61/20* (2013.01); *B65D 77/26* (2013.01)

(58) Field of Classification Search

USPC ..... 206/730, 734, 806, 756, 758, 764, 765,206/761, 763, 731, 732, 733, 735

See application file for complete search history.

(56) References Cited

U.S. PATENT DOCUMENTS

| | | | | |
|---|---|---|---|---|
| 1,453,480 | A | 5/1923 | Sanders | |
| 1,569,679 | A | 1/1926 | Sanborn | |
| 1,844,189 | A * | 2/1932 | Stuart | B65D 5/38 206/534 |
| 1,890,181 | A | 12/1932 | Hoffman | |
| 1,959,665 | A | 5/1934 | Gallinger | |
| 1,959,923 | A | 5/1934 | Middleton | |
| 2,162,089 | A | 6/1939 | Kagen | |
| 2,219,183 | A * | 10/1940 | Hartnett | B65D 5/4204 206/338 |
| 2,312,532 | A | 3/1943 | Engstrom | |
| 2,313,718 | A * | 3/1943 | Berg | B65D 5/48002 206/315.9 |
| 2,683,530 | A | 7/1954 | Seyforth | |
| 2,827,219 | A * | 3/1958 | Sparks | B65D 5/5038 206/588 |
| 2,858,938 | A | 11/1958 | Seyforth | |

(Continued)

*Primary Examiner* — Jacob K Ackun

(74) *Attorney, Agent, or Firm* — JoAnn M. Seaton; Griffiths & Seaton PLLC

(57) ABSTRACT

A package includes a box and an insert. The box includes a front wall and defines a compartment therein. The front wall defines an open window between a top window edge and a bottom window edge of the front wall. The open window provides direct access to the compartment. The insert is maintained within the compartment and defines a top chamber panel adjacent the top window edge, a rear chamber panel, and a bottom chamber panel adjacent the bottom window edge. The insert is maintained within the compartment such that the bottom chamber panel divides the compartment into at least an open chamber and a closed chamber. The open chamber is defined immediately adjacent the open window between the top chamber panel and the bottom chamber panel. The closed chamber is defined on a side of the bottom chamber panel opposite the open chamber.

18 Claims, 23 Drawing Sheets

(56) References Cited

U.S. PATENT DOCUMENTS 3,057,466 A * 10/1962 Blonder ..... B65D 5/5007 206/781
3,298,504 A 1/1967 Carter
3,407,524 A 10/1968 Schladermundt
3,659,704 A * 5/1972 Collura ..... B65D 5/4208 206/288
4,146,128 A 3/1979 Hogg et al.
D272,805 S 2/1984 Johnsen
D306,806 S 3/1990 Hill
4,915,224 A * 4/1990 Wulf ..... B65D 85/505 206/423
4,957,202 A * 9/1990 Yoshiki ..... B65D 21/0237 206/277
5,405,003 A 4/1995 Schmidt et al.
5,813,523 A * 9/1998 Gnadt ..... B65D 5/4204 206/590
6,598,746 B2 7/2003 Lux, Jr. et al.
D493,715 S 8/2004 Izen et al.
D496,265 S 9/2004 Dossett et al.
7,650,997 B2 1/2010 Nago
D633,381 S 3/2011 Klauder
8,235,204 B2 * 8/2012 Loughman ..... B65D 5/38 206/1.5
8,434,288 B2 5/2013 Titkos
8,459,460 B1 * 6/2013 Hansen ..... B31B 17/00 206/462
8,905,240 B2 * 12/2014 Park ..... A45D 29/18 206/581
2006/0266672 A1 * 11/2006 Young ..... B65D 77/0433 206/776
2007/0151898 A1 * 7/2007 Coppola ..... B65D 5/52 206/733
2007/0235051 A1 * 10/2007 Robinson ..... A45D 29/18 132/73.5
2009/0236351 A1 9/2009 Chu et al.

* cited by examiner

PACKAGE WITH OPEN CHAMBER

BACKGROUND OF THE INVENTION

Various types of packaging are used for storing and displaying products, for example, in a retail environment. It is often desirable to allow a potential consumer to see and/or feel a product housed within the packaging before purchase. To facilitate consumer visual inspection, in retail environments, clear plastic clamshell containers or blister packages are commonly used. Other packaging techniques incorporate clear viewing windows or other features visually displaying the products through the associated package(s). In some instances, such packages are difficult to open, are not readily reusable, and/or have relatively high assembly costs. In addition, such packages generally do not allow for tactile inspection of the product while still securely maintaining the product for transport and display.

SUMMARY OF THE INVENTION

One aspect of the present invention relates to a package including a box and an insert. The box includes a front wall and defines a compartment therein. The front wall defines an open window between a top window edge and a bottom window edge of the front wall. The open window provides direct access to the compartment. The insert is maintained within the compartment and defines a top chamber panel adjacent the top window edge, a rear chamber panel, and a bottom chamber panel adjacent the bottom window edge. The insert is maintained within the compartment such that the bottom chamber panel divides the compartment into at least an open chamber and a closed chamber. The open chamber is defined immediately adjacent the open window between the top chamber panel and the bottom chamber panel. The closed chamber is defined on a side of the bottom chamber panel opposite the open chamber. Other apparatus, assemblies, and associated methods are also disclosed.

BRIEF DESCRIPTION OF THE DRAWINGS

Embodiments of the invention will be described with respect to the figures, in which like reference numerals denote like elements, and in which.

DETAILED DESCRIPTION

Packages for products being offered for retail sale not only serve as containers for the products during transport and store placement, but also enhance the products by presenting the product in a manner designed to encourage product purchase or to otherwise market the product to promote its purchase. A package, as described herein, maintains a plurality of products for sale as a single unit and is configured to present one or more, but generally not all, of the plurality of products in an open chamber of the package. In one example, the one or more of the plurality of products are representative of other ones of the plurality of products. In this manner, the package allows potential consumers to visually and tactilely assess the representative products prior to deciding whether to purchase the plurality of products. In one example, the open chamber is at least partially covered on at least three sides such that the package protects the representative products from inadvertent damage during transport and display while leaving the representative products partially exposed. In one example, the other ones of the plurality of products, that is, the products not positioned in the open chamber, are maintained in a enclosed chamber of the package.

The packages, according to one embodiment of the invention, are configured for relatively easy construction, in one embodiment, free from other securement devices, presenting a clean overall package and product display while lowering overall manufacturing costs associated with the package. In one example, the package is readily recyclable. Other features and embodiments are also described below.

Figure 16:
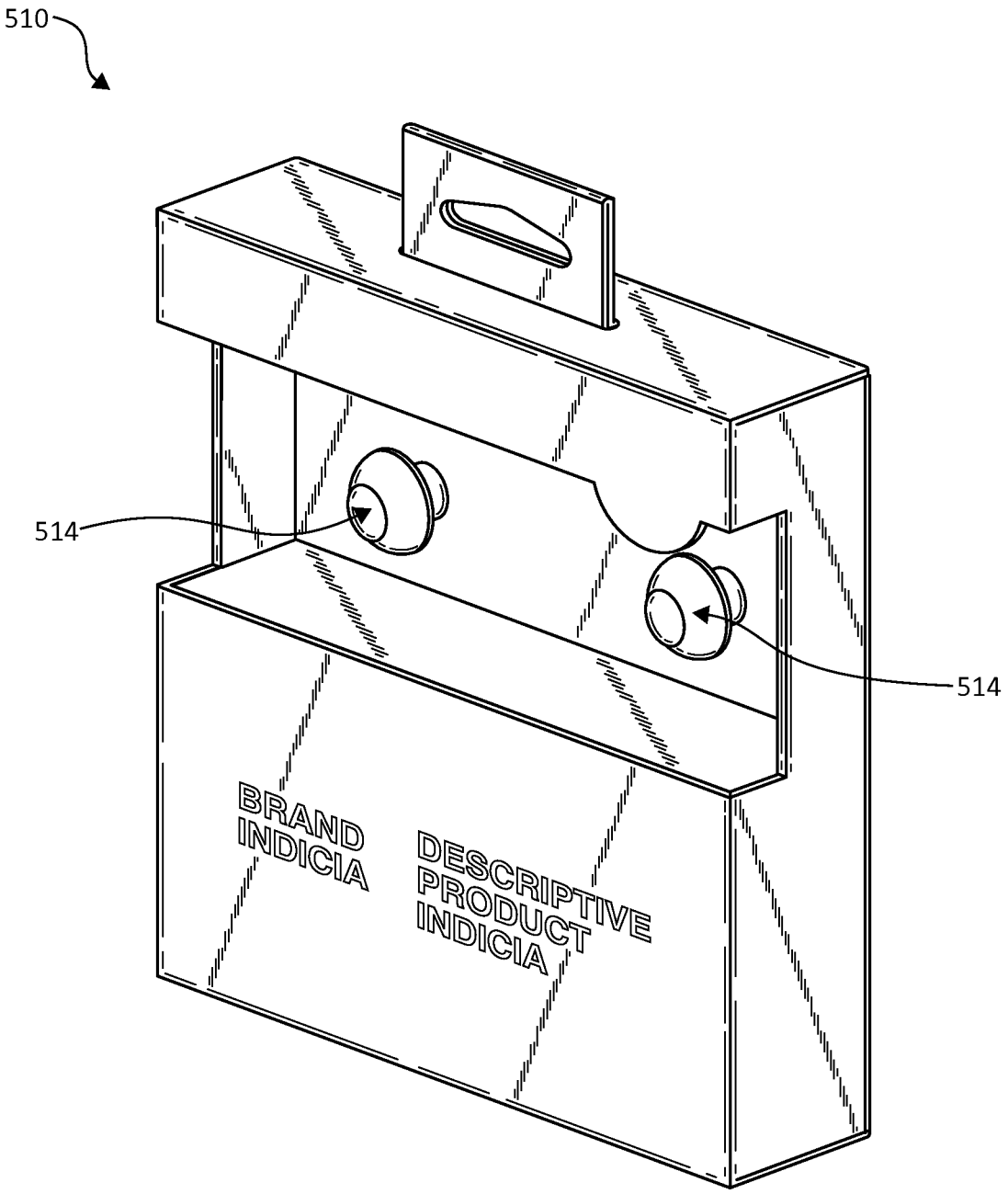
FIG. 16 is a front perspective view illustration of a packaged product, according to one embodiment of the present invention.
Figure 17:
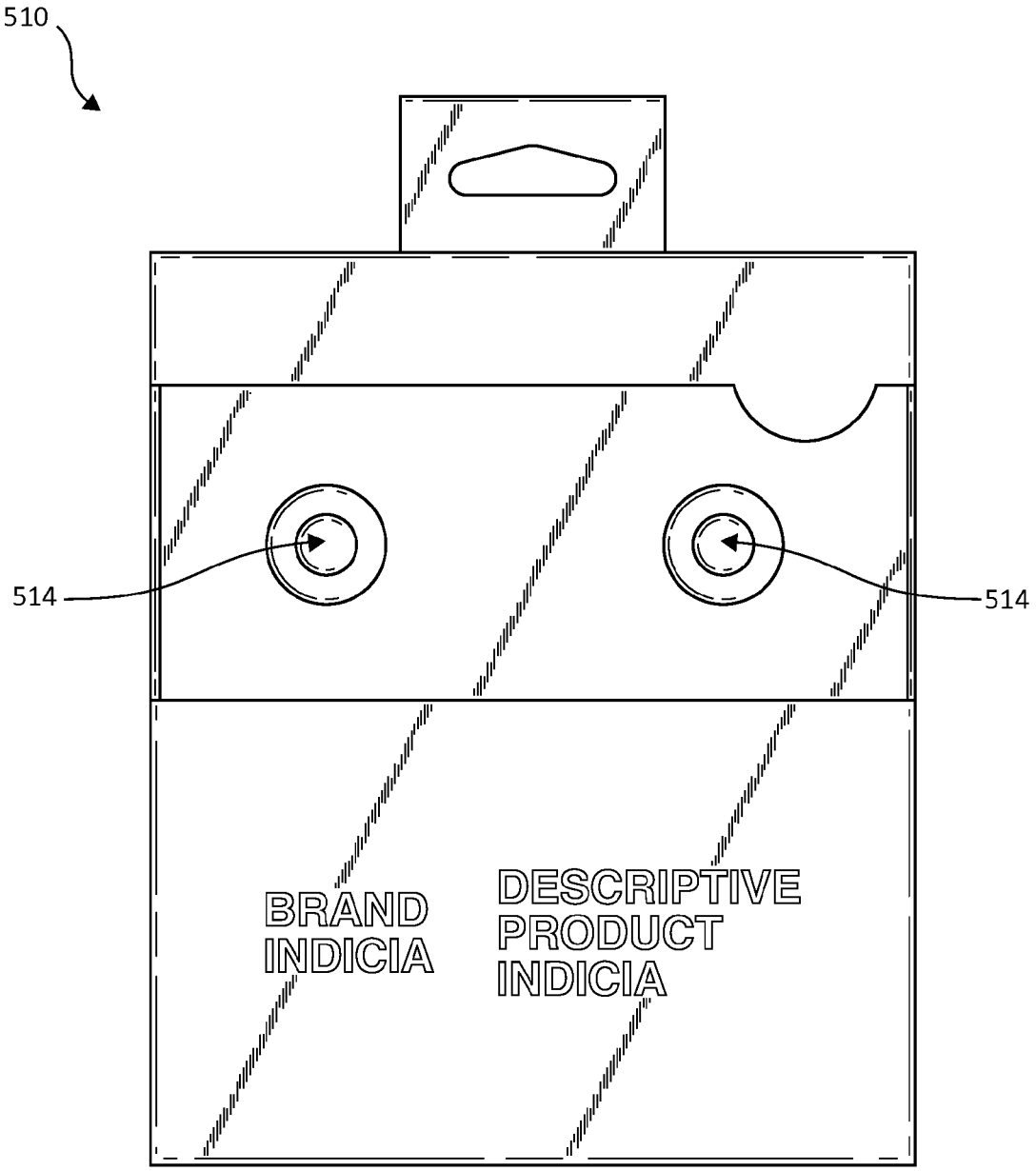
FIG. 17 is a front view illustration of the packaged product of FIG. 16, according to one embodiment of the present invention.
Figure 18:
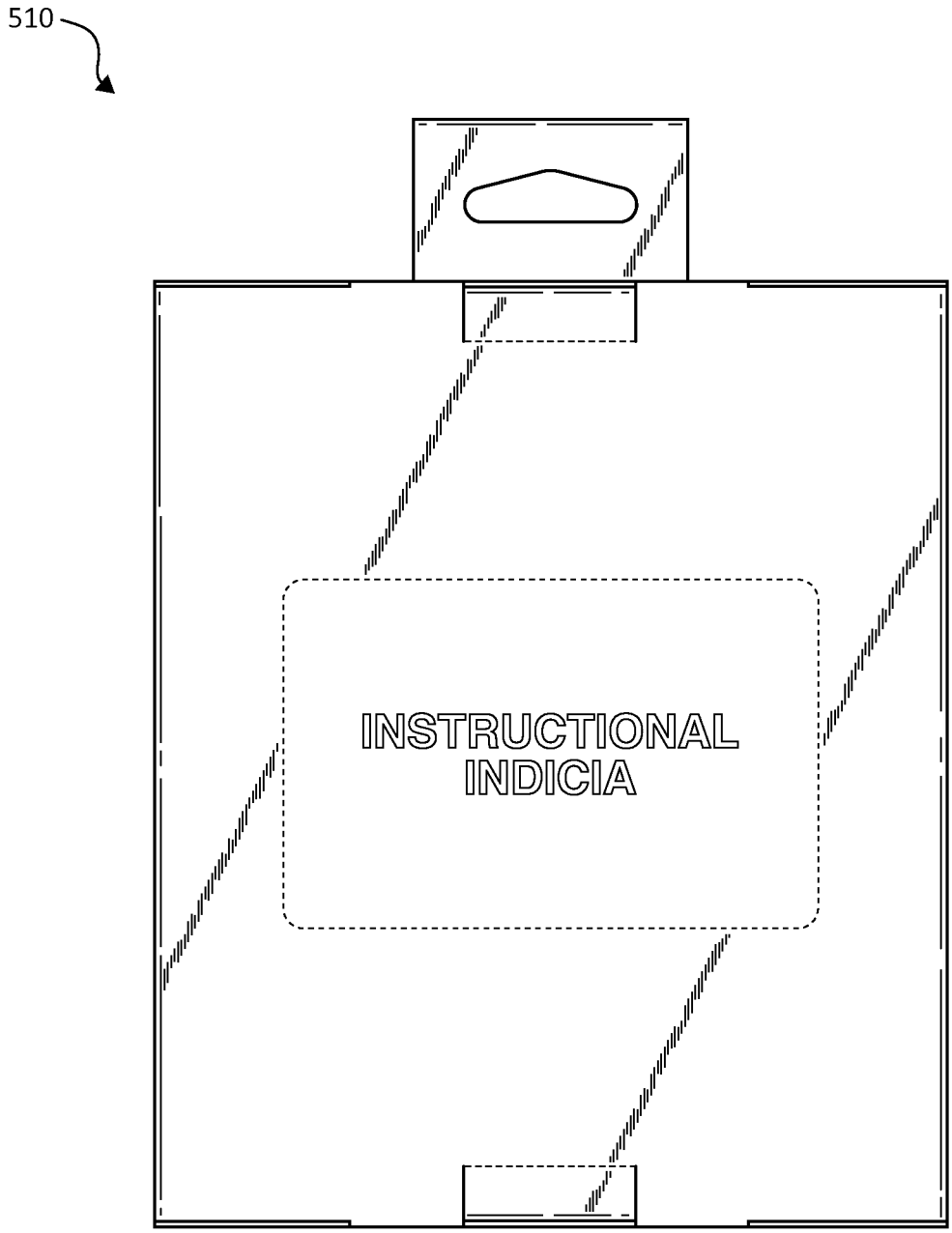
FIG. 18 is a rear view illustration of the packaged product of FIG. 16, according to one embodiment of the present invention.
Figure 19:
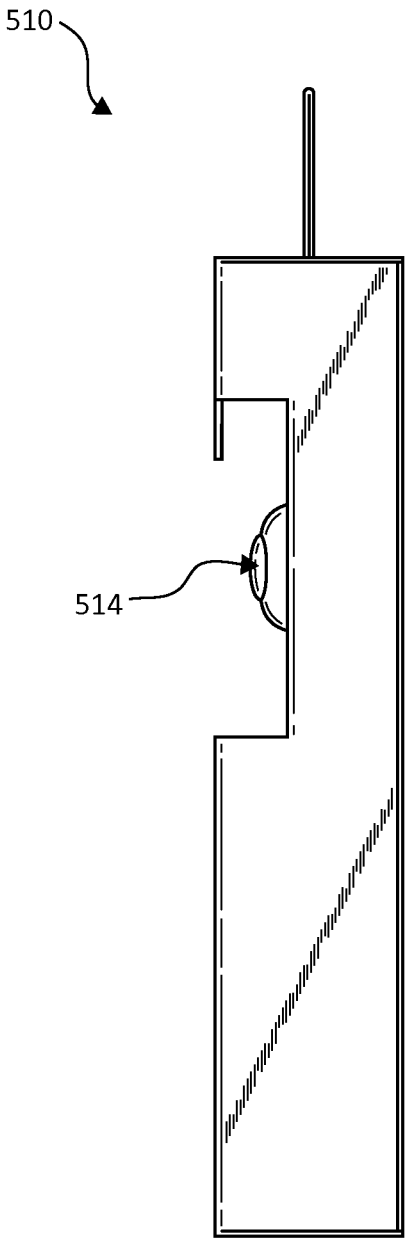
FIG. 19 is a right side view illustration of the packaged product of FIG. 16, according to one embodiment of the present invention.
Figure 20:
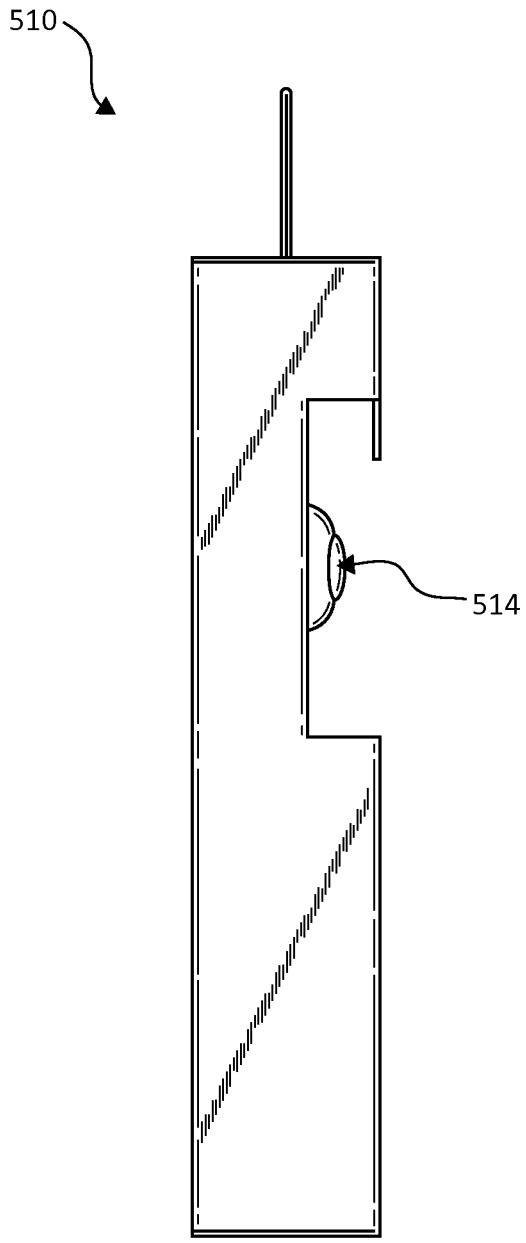
FIG. 20 is a left side view illustration of the packaged product of FIG. 16, according to one embodiment of the present invention.
Figure 21:
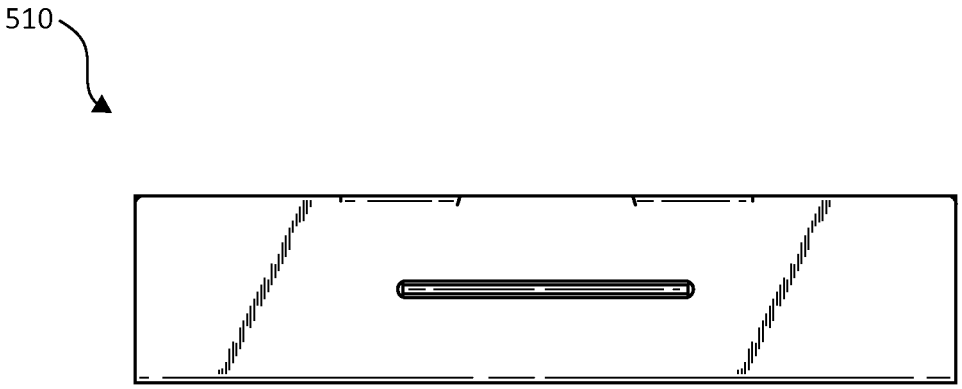
FIG. 21 is a top view illustration of the packaged product of FIG. 16 according to one embodiment of the present invention.
Figure 22:
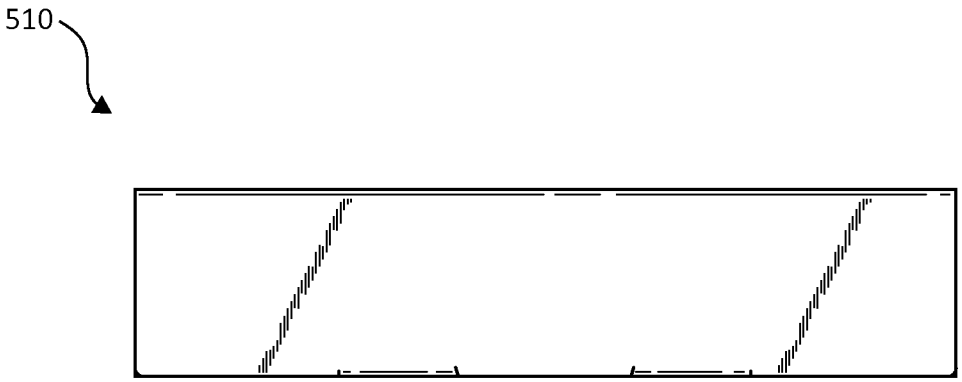
FIG. 22 is a bottom view illustration of the packaged product of FIG. 16, according to one embodiment of the present invention.
Figure 23:
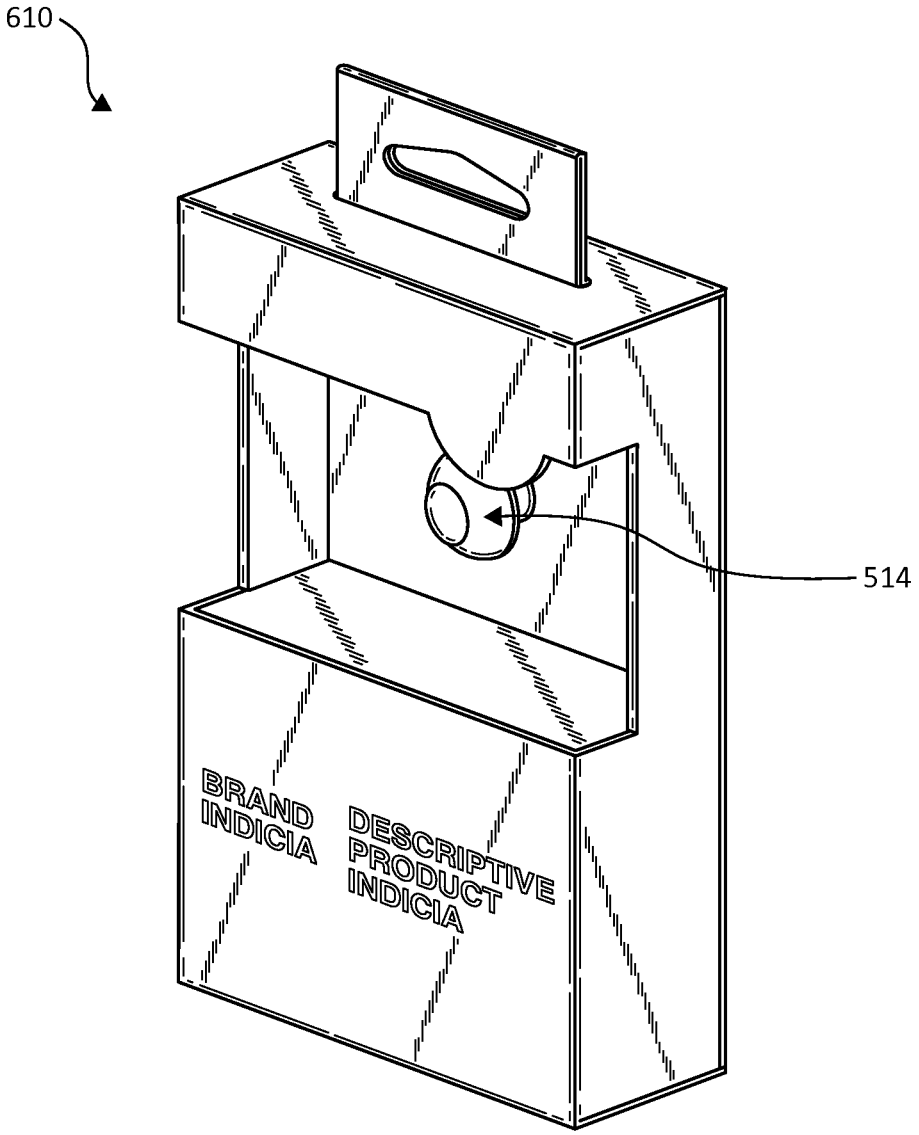
FIG. 23 is a front perspective view illustration of a packaged product, according to one embodiment of the present invention.
Figure 24:
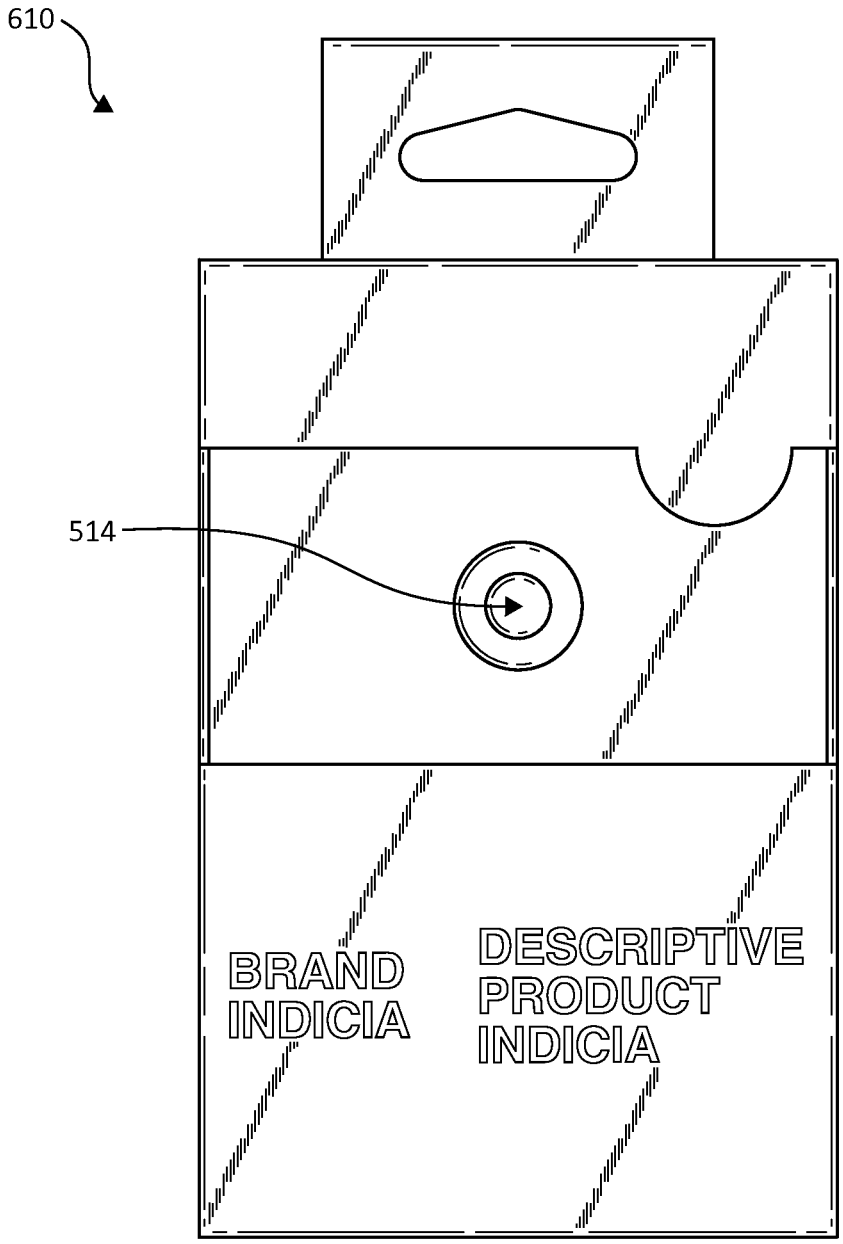
FIG. 24 is a front view illustration of the packaged product of FIG. 23, according to one embodiment of the present invention.
Figure 25:
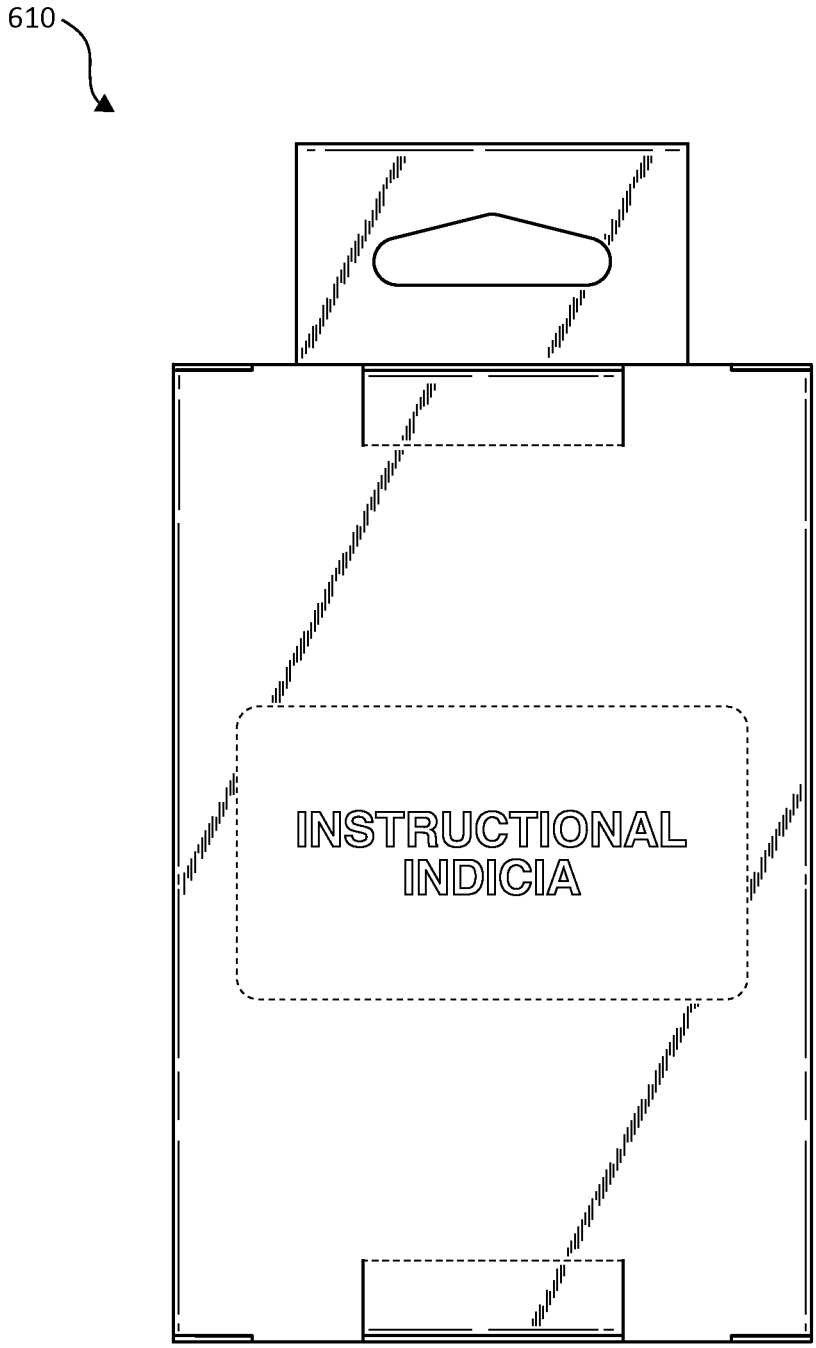
FIG. 25 is a rear view illustration of the packaged product of FIG. 23, according to one embodiment of the present invention.
Figure 26:
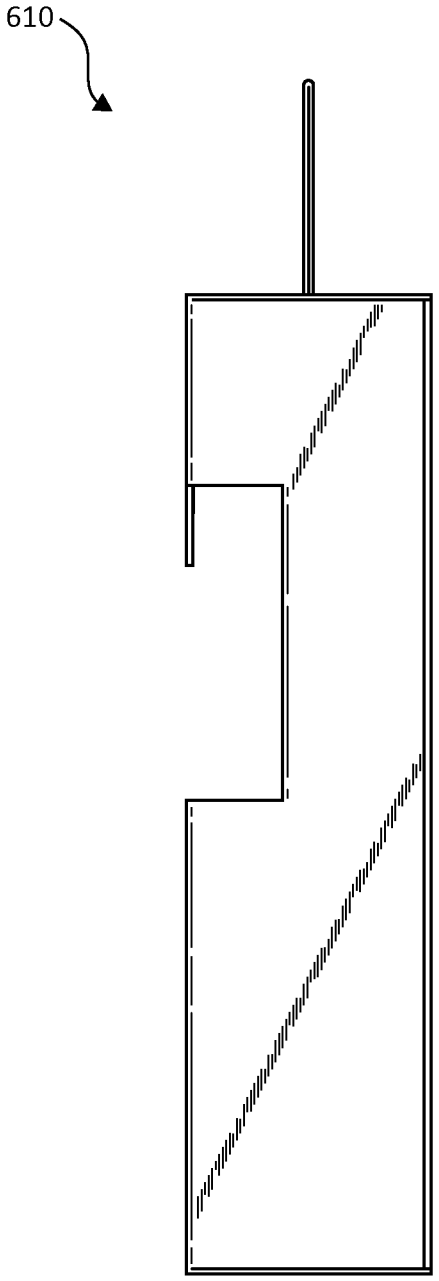
FIG. 26 is a right side view illustration of the packaged product of FIG. 23, according to one embodiment of the present invention.
Figure 27:
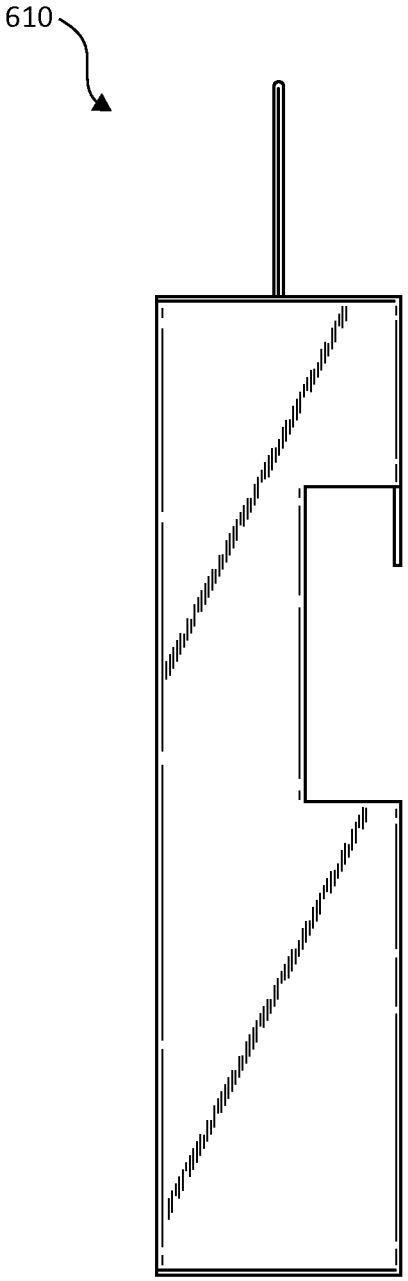
FIG. 27 is a left side view illustration of the packaged product of FIG. 23, according to one embodiment of the present invention.
Figure 28:
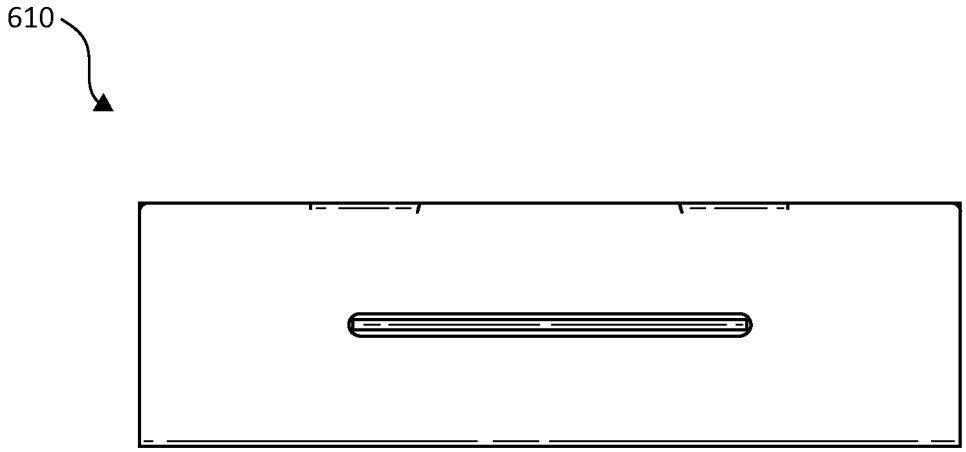
FIG. 28 is a top view illustration of the packaged product of FIG. 23 according to one embodiment of the present invention.
Figure 29:
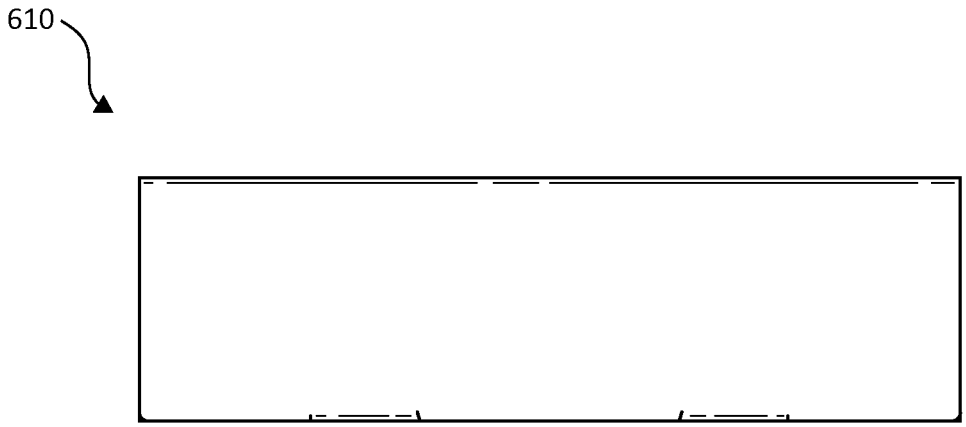
FIG. 29 is a bottom view illustration of the packaged product of FIG. 23, according to one embodiment of the present invention.

Turning to the figures, FIGS. 1-7 illustrate a packaged product 10 including a package 12 and a plurality of products 14 maintained therein, according to one embodiment of the present invention. Package 12 includes a primary member or box 16 and an insert 18, which collectively define an enclosed chamber 20 (see FIG. 16) and an open chamber 22. First ones of the plurality of products 14 are maintained in enclosed chamber 20 while second or sample ones of the plurality of products 14, e.g., one or two of the plurality of products 14, are secured within open chamber 22. The sample ones of products 14 is at least partially exposed allowing a consumer to visually and tactilely observe the sample ones of the plurality of products 14. In one example, as illustrated, the plurality of products 14 is a plurality of cabinet hardware, e.g., pulls, handles, etc.; however, package 12 may be used with other suitable products 14. Other accessories or mounting hardware 24, such as the screws illustrated in FIG. 8, may also be maintained in enclosed chamber 20.

Figure 8:
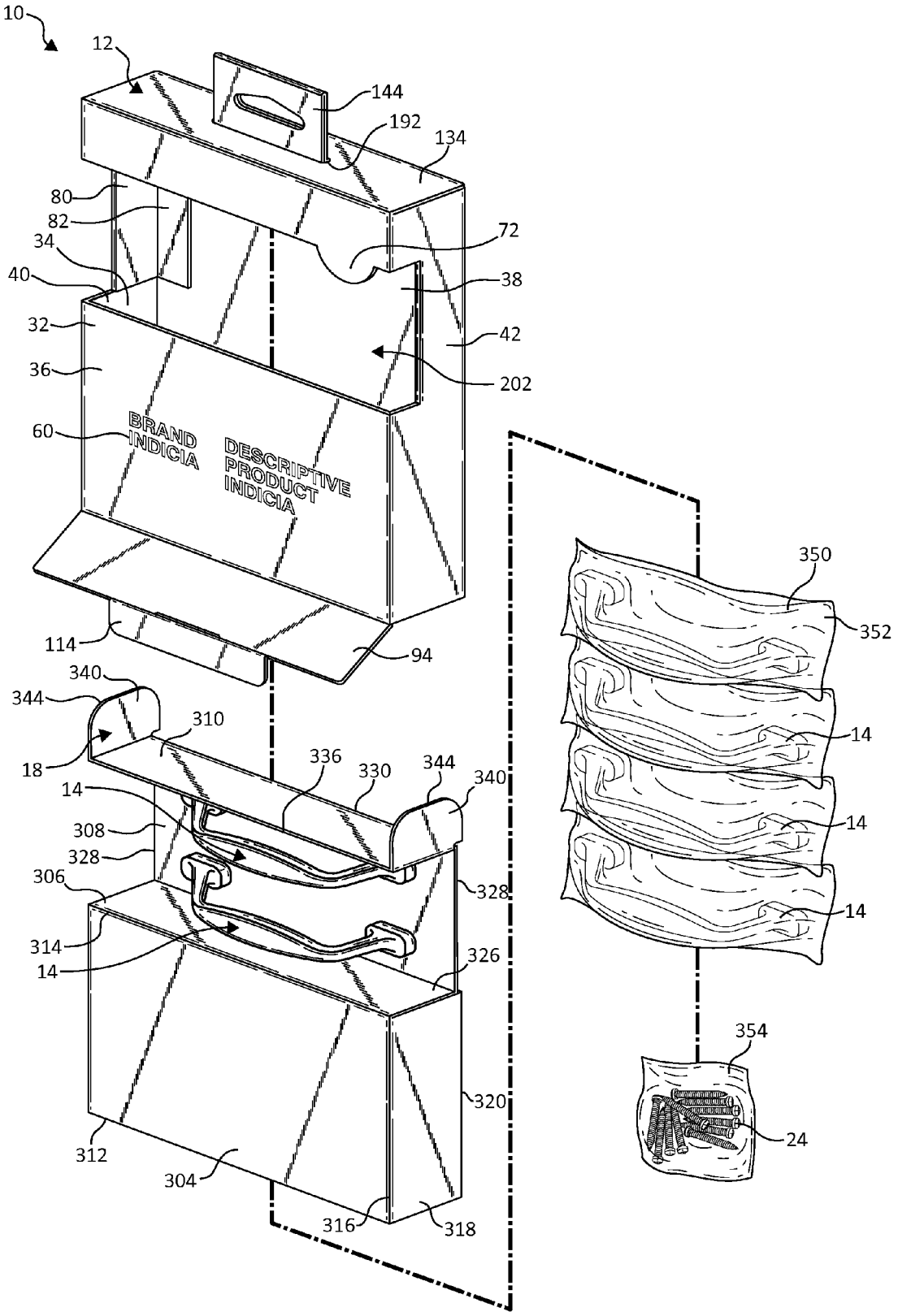
FIG. 8 is a partially exploded, front perspective view illustration of the packaged product of FIG. 1, according to one embodiment of the present invention.
Figure 9:
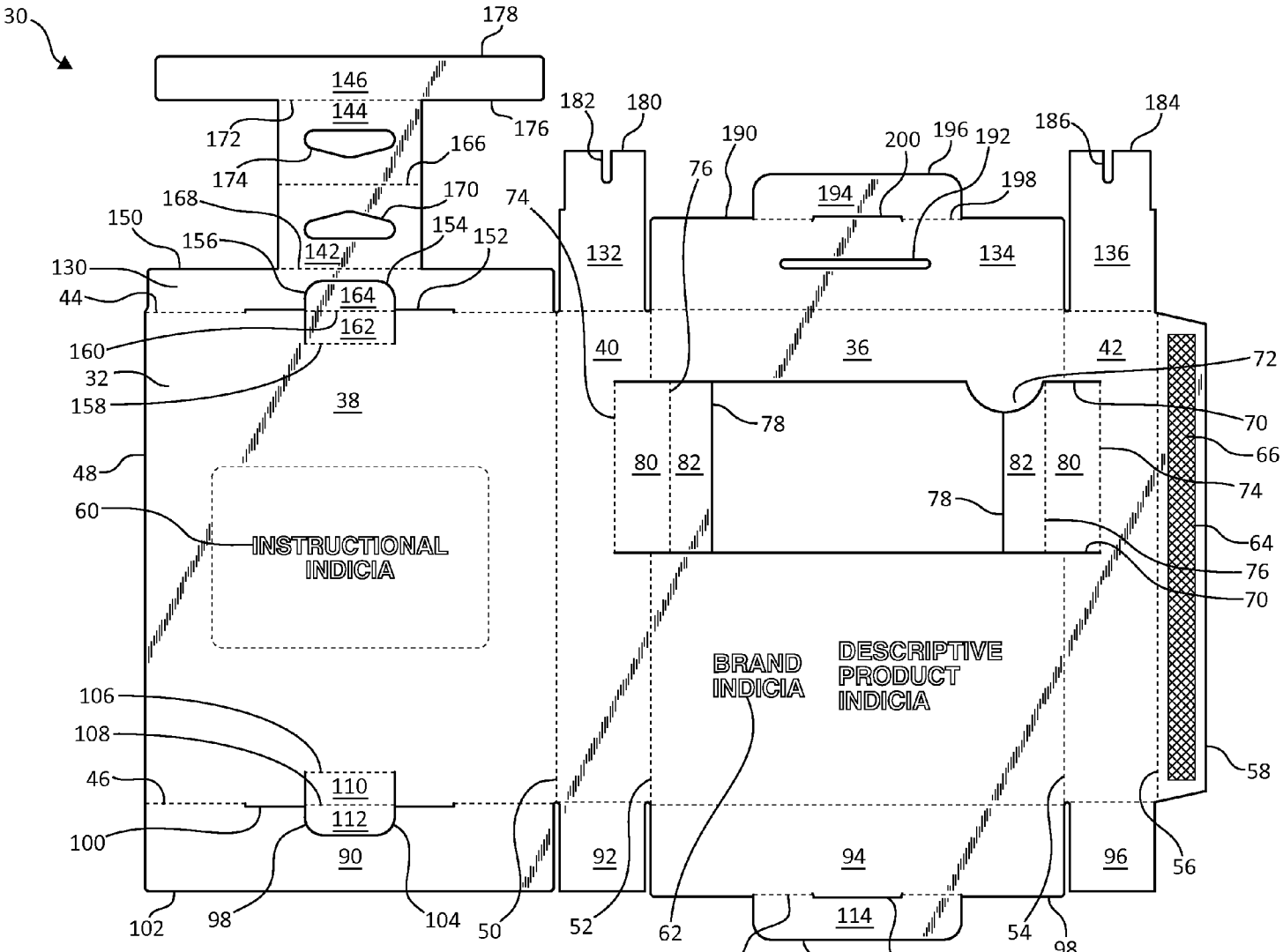
FIG. 9 is a front view illustration of an unfolded primary blank that is foldable to become at least a portion of a package of the packaged product of FIG. 1, accordingly to one embodiment of the present invention.

Referring additionally to the exploded perspective view of FIG. 8, box 16 is formed and generally receives and wraps about insert 18. In one embodiment, each of box 16 and insert 18 are formed of a single piece of a planar material, such as cardboard, paperboard, etc., folded to form the various components of each of box 16 and insert 18. For instance, FIG. 9 illustrates a flattened blank 30 is configured to be folded to form box 16. Blank 30 is substantially planar and defines an exterior surface 32 and an interior surface 34 (see, e.g., FIGS. 8, 13, 15, and 16) opposite exterior surface 32. In one example, each of exterior surface 32 and interior surface 34 are substantially planar and is divided by various cuts and fold lines to define a front wall 36, a rear wall 38, a first sidewall 40, and a second sidewall 42. Front wall 36, rear wall 38, first sidewall 40, and second sidewall 42 each have a substantially identical overall height measured between a longitudinally extending, top fold line 44 and a longitudinally extending, bottom fold line 46 of blank 30, according to one embodiment. In one example, top fold line 44 and bottom fold line 46 are spaced from and extend substantially parallel to one another. Blank 30 further includes a free longitudinal edge 48, a first longitudinal fold line 50, a second longitudinal fold line 52, a third longitudinal fold line 54, a fourth longitudinal fold line 56, and a second free longitudinal edge 58 each being substantially linear, extending substantially parallel to one another, and/or, in one example, extending substantially perpendicularly to top fold line 44 and bottom fold line 46.

In the embodiment illustrated in FIG. 9, rear wall 38 generally extends from free longitudinal edge 48 of blank 30 to first longitudinal fold line 50. Rear wall 38 is substantially rectangular and, in one example, includes instructional or other indicia 60 providing marketing, product information, branding, instructional information, etc. to the consumer viewing package 12. First sidewall 40 is adjacent to and generally extends from first longitudinal fold line 50 away from rear wall 38 to second longitudinal fold line 52. Front wall 36 is adjacent to and extends from second longitudinal fold line 52, away from front wall 36, and to third longitudinal fold line 54. Front wall 36 is substantially rectangular and, in one example, includes instructional or other indicia 62 providing marketing, product information, branding, instructional information, etc. to the consumer viewing package 12. In one example, the overall shape and size of front wall 36 is substantially identical to the overall shape and size of rear wall 38. Second sidewall 42 is adjacent to and extends from third longitudinal fold line 54 to fourth longitudinal fold line 56. In one embodiment, second sidewall 42 is a mirror image of first sidewall 40.

Figure 13:
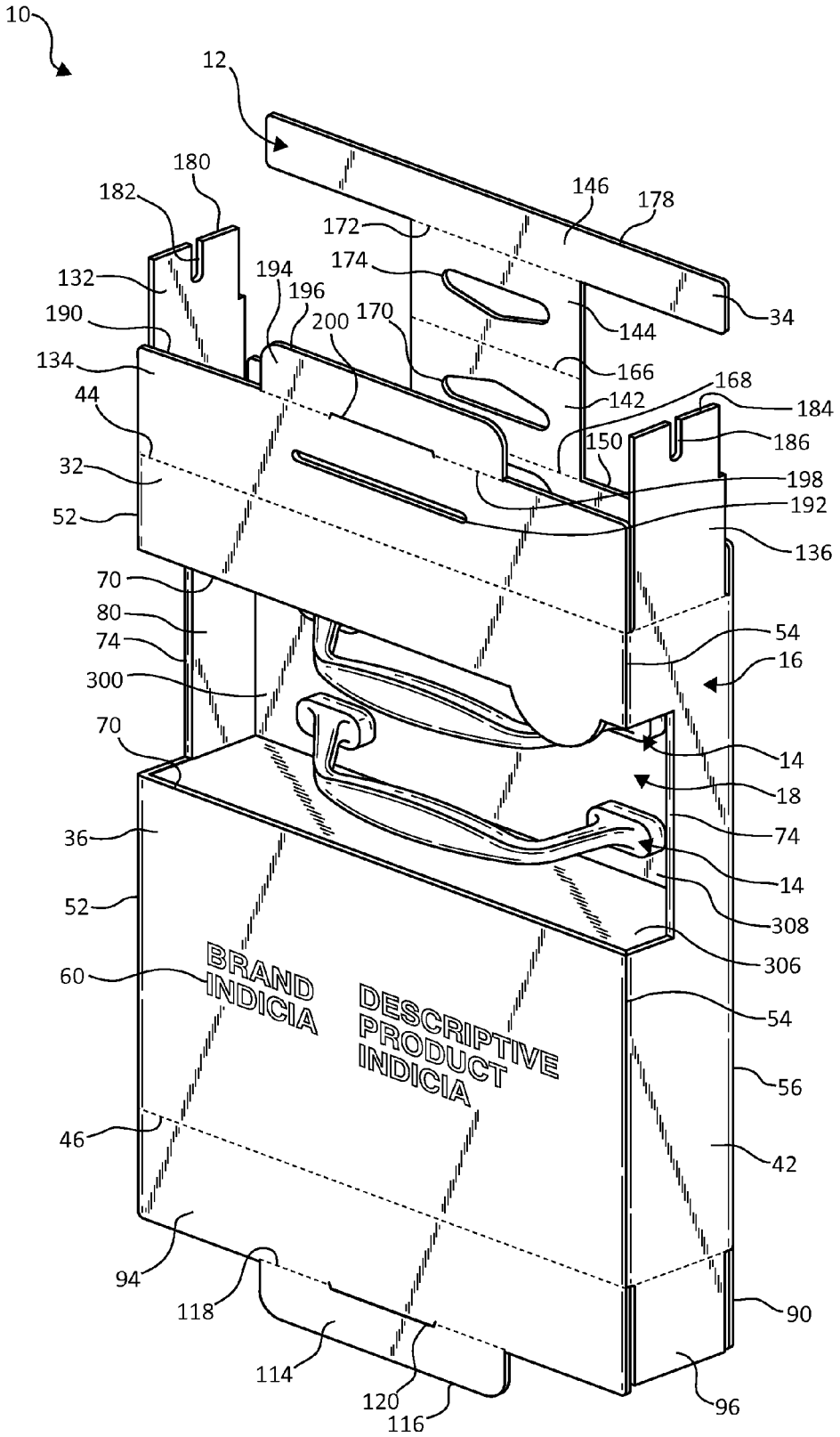
FIG. 13 is a front perspective view illustration of a partially assembled packaged product including a partially folded primary blank being assembled with the folded insert blank and products of FIG. 11, accordingly to one embodiment of the present invention.

As will be further described below, blank 30 is configured to be folded about first, second, third, and fourth longitudinal fold lines 50, 52, 54, and 56 to form a compartment therebetween (not shown). In one example, blank 30 includes a longitudinal coupling tab 64 positioned adjacent fourth longitudinal fold line 56 and extending away from second sidewall 42. Coupling tab 62 has an overall height equal to or less than an overall height of each of second sidewall 42 and rear wall 38 and, in one example, includes adhesive 66 or other coupling agent along a portion of exterior surface 32. When rear wall 38, first sidewall 40, front wall 36, and second sidewall 42 are fold inwardly toward one another, coupling tab 64 adheres or is otherwise coupled to a portion of interior surface 34 defined by rear wall 38, for example, along free longitudinal edge 48. Adhesive 66, which is eliminated in other embodiments, facilitates maintenance of blank 30 in at least a partially folded configuration, for example, as shown in FIG. 13. While described as extending from second sidewall 42, in one example (not shown), coupling tab 64 instead extends from rear wall 38 and adheres or otherwise couples with a portion of interior surface 34 formed by second sidewall 42.

In one example, longitudinally spaced, lateral window cuts 70 are formed through front wall 36 and across each of second longitudinal fold line 52 and third longitudinal fold line 54 into first and second sidewalls 40 and 42. Lateral window cuts 70 are, in one embodiment, substantially parallel to one another and spaced apart from one another to define an overall height of open chamber 22 (see, e.g., FIGS. 1 and 2) therebetween. As illustrated, each lateral window cut 70 is substantially linear other than any aesthetic deviations 72.

A different first window longitudinal fold line 74 extends between each of adjacent ends of lateral window cuts 70, for example, substantially perpendicularly relative to lateral window cuts 70. In one embodiment, each of first window longitudinal fold lines 74 extends substantially parallel to each of first, second, third, and fourth longitudinal fold lines 50, 52, 54, and 56.

Blank 30 further includes a second window longitudinal fold line 76 and a free sidewall longitudinal window edge 78, which are each parallel to a corresponding first window longitudinal fold line 74. Second window longitudinal fold line 76 and free sidewall longitudinal window edge 78 are each respectively spaced further away from the corresponding first window longitudinal fold line 74. In one example, blank 30 forms a void between opposing free sidewall longitudinal window edges 78 and lateral window cuts 70.

In one embodiment, blank 30 further defines open chamber sidewalls 80 and side coupling tabs 82. Each of two open chamber sidewalls 80 is defined between a different first window longitudinal fold line 74 and an adjacent one of second window longitudinal fold lines 76. A different one of side coupling tabs 82 is defined between each one of second window longitudinal fold lines 76 and an adjacent one of the free sidewall longitudinal window edges 78. When blank 30 is folded into box 16 (FIGS. 1-8), an open window 84 is defined by rearwardly folding first window longitudinal fold lines 74 and inwardly folding second window longitudinal fold line 76 to provide an opening or access to open chamber 22, for example, as will be further described below. As such, each window cut 70 defines a differently one of a top window edge and an opposing bottom window edge on opposing perimeter edge of open window 84.

Continuing to refer to FIG. 9, blank 30 additionally includes an interior bottom wall 90, a first side bottom wall 92, an exterior bottom wall 94, and a second side bottom wall 96 each extending downwardly from bottom fold line 46, respectively, adjacent and with a width substantially identical to rear wall 38, first sidewall 40, front wall 36, and second sidewall 42. Each of interior bottom wall 90, first side bottom wall 92, exterior bottom wall 94, and second side bottom wall 96 extends from bottom fold line 46 a substantially identical distance to a corresponding free edge 98 and is configured to fold inwardly to collectively define a bottom of box 16.

In one embodiment, a slit 100 is centered within and formed along a portion of bottom fold line 46 immediately adjacent rear wall 38. In one example, slit 100 is interrupted at a center thereof to form a coupling tab 102 extending therethrough. More specifically, in one embodiment, a U-shaped cut 104 starts in rear wall 38, extends downwardly though slit 100 into interior bottom wall 90, and back up through slit 100 into an interior of rear wall 38. Blank 30 includes a lateral tab fold line 106 extends across opposing ends of U-shaped cut 104, in one example, substantially parallel to bottom fold line 46. An interior tab fold line 108 extends parallel to tab fold line 106 at a location substantially collinear with slit 100, for instance, in a manner dividing coupling tab 102 into a first portion 110, which is adjacent tab fold line 106, and a second portion 112, which is positioned on a side of interior tab fold line 108 opposite first portion 110.

Blank 30 additionally includes a bottom lateral flange 114 extending downwardly from exterior bottom wall 94, more particularly, from free edge 98 of exterior bottom wall 94 to a free edge 116. A lateral flange fold line 118 separates bottom lateral flange 114 from exterior bottom wall 94 and is substantially collinear with free edge 98. A slit or cut 120 extends along a center portion of lateral flange fold line 118 with a width substantially equal to or greater than a width of coupling tab 102.

In one embodiment, blank 30 includes an internal top wall 130, a first side top wall 132, an exterior top wall 134, and a second side top wall 136 each extending upwardly from top fold line 44 adjacent and with a width substantially identical to a different one of rear wall 38, first sidewall 40, front wall 36, and second sidewall 42, respectively. Each of internal top wall 130, first side top wall 132, exterior top wall 134, and second side top wall 136 is configured to fold inwardly to collectively define a top of box 16. In one example, internal top wall 130 includes a rear top wall portion 140, a rear hang tab portion 142, a front hang tab portion 144, and a front top wall portion 146. Rear top wall portion 140 extends upwardly from top fold line 44 above rear wall 38, for instance, with a width substantially equal to a width of rear wall 38, to an interior edge 150.

In one embodiment, a slit 152 is centered within and formed along a portion of top fold line 44 immediately adjacent rear wall 38. Slit 152 is interrupted at a center thereof to form a coupling tab 154 extending therethrough, in one example. More specifically, in one embodiment, a U-shaped cut 156 starts in rear wall 38, extends upwardly though slit 152 into rear top wall portion 140, and back down through slit 152 into an interior of rear wall 38. Blank 30 includes a lateral tab fold line 158 extending across opposing ends of U-shaped cut 156, in one example, substantially parallel to top fold line 44. An interior tab fold line 160 extends parallel to tab fold line 158 at a location substantially collinear with slit 152 in a manner dividing coupling tab 154 into a first portion 162 adjacent tab fold line 158 and a second portion 164 positioned on a side of interior tab fold line 160 opposite first portion 162.

Rear hang tab portion 142 extends further upwardly from, and one example, in a position substantially laterally centered on interior edge 150, to a hang tab top fold line 166. In this manner, a tab fold line 168 is defined between rear hang tab portion 142 and rear top wall portion 140 that is substantially collinear with interior edge 150. In one example, rear hang tab portion 142 has a width substantially less than, for example, less than about half or less than about one-third, a width of rear top wall portion 140. A first hang aperture 170 is formed in an interior of rear hang tab portion 142 and is configured to receive a display support rod (not shown) to hang package 12. Front hang tab portion 144 is sized substantially identically to and positioned adjacent to rear hang tab portion 142. Front hang tab portion 144 borders rear hang tab portion 142 along hang tab top fold line 166 and extends away from hang tab top fold line 166 to a tab fold line 172. In one embodiment, front hang tab portion 144 includes a second hang aperture 174 sized substantially identically to and symmetrically positioned relative to first hang aperture 170 about hang tab top fold line 166.

Front top wall portion 146 of internal top wall 130 is sized overall substantially identically to and symmetrically positioned relative to rear top wall portion 140 about hang tab top fold line 166, according to one embodiment. In this manner, front top wall portion 146 defines an interior edge 176, which is substantially collinear with tab fold line 172, and extends laterally on either side thereof. Front top wall portion 146 extends from interior edge 176 to a free external edge 178 extending substantially parallel to interior edge 176. In one embodiment, a combined depth of rear top wall portion 140 as measured between top fold line 44 and interior edge 150 and of front top wall portion 146 as measured between interior edge 176 and free external edge 178 is substantially equal to or less than about an interior depth of open chamber 22 (see, e.g., FIG. 1).

In one embodiment, first side top wall 132 extends from top fold line 44 adjacent to and with a substantially identical width as first sidewall 40 away from first sidewall 40 to an opposite free edge 180. In one example, a cutout 182 extends into an interior of first side top wall 132 with a width at least slightly greater than a double thickness of blank 30, for instance, in a position to fit around both rear hang tab portion 142 and front hang tab portion 144 upon assembly. Second side top wall 136 extends from top fold line 44 above second sidewall 42 in a substantially symmetrical manner as first side top wall 132 extends above and relative to first sidewall 40. For example, second side top wall 136 extends from top fold line 44 to an opposing free edge 184, which defines a cutout 186 substantially identical to cutout 182. Cutout 186, like cutout 182, is configured to receive a side portion of each of rear hang tab portion 142 and front hang tab portion 144 when blank 30 is folded to form box 16.

Exterior top wall 134 extends upwardly from top fold line 44 to a free edge 190, which is substantially parallel to top fold line 44, in one embodiment, and is positioned at a location just above front wall 36. In one example, exterior top wall 134 has a width substantially identical to front wall 36. Exterior top wall 134 defines a slit or an elongated opening 192 primarily extending in a direction substantially parallel with top fold line 44 and in a location substantially centered in exterior top wall 134. As described herein, internal top wall 130, exterior top wall 134, and first side top wall 132, and/or second side top wall 136 collectively define a top of box 16.

In one example, blank 30 includes a lateral flange 194 extending upwardly from exterior top wall 134, more particularly, from free edge 190 of exterior top wall 134 to a free edge 196. A lateral flange fold line 198 separates lateral flange 194 from exterior top wall 134 and is substantially collinear with free edge 190, in one embodiment. A slit or cut 200 extends along a center portion of lateral flange fold line 198 with a width substantially equal to or greater than a width of coupling tab 154.

Figure 10:
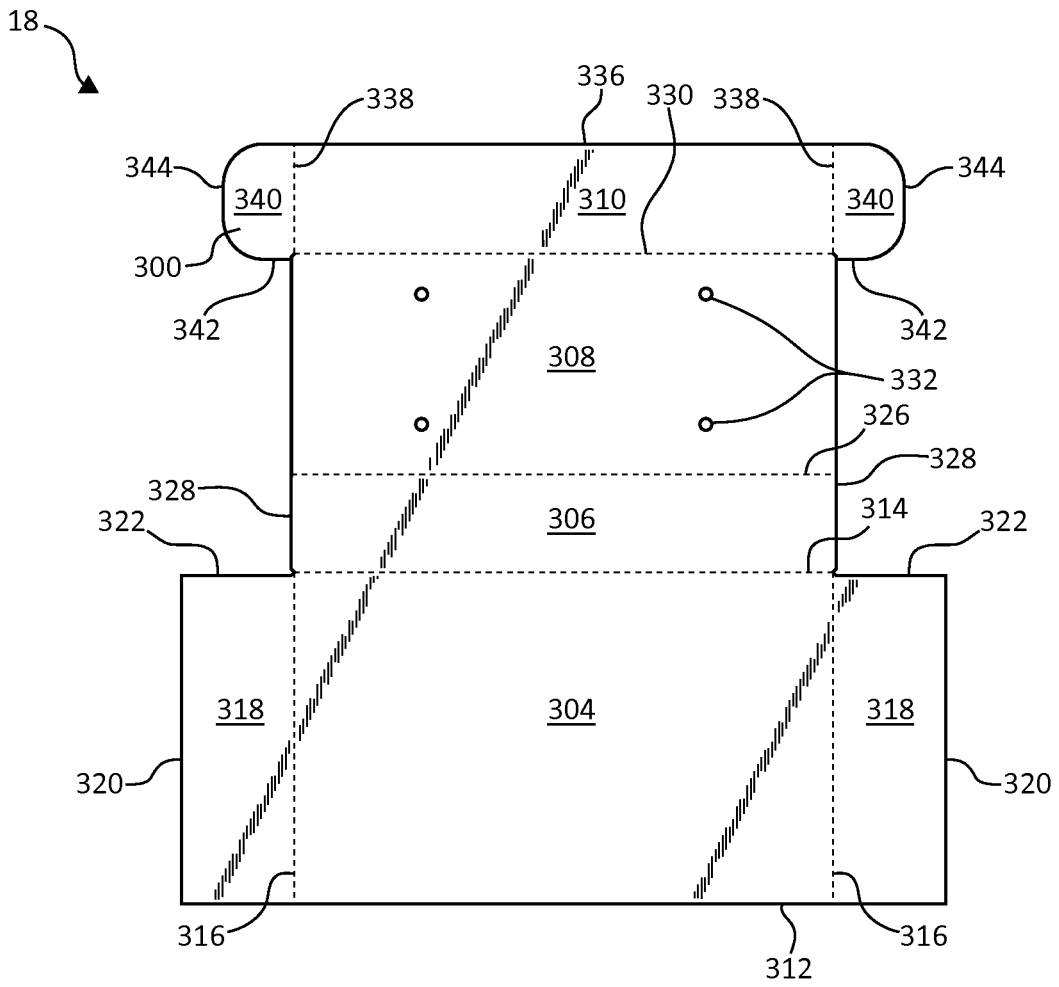
FIG. 10 is a front view illustration of an unfolded insert blank that is foldable to become a portion of a package of the packaged product of FIG. 1, accordingly to one embodiment of the present invention.
Figure 11:
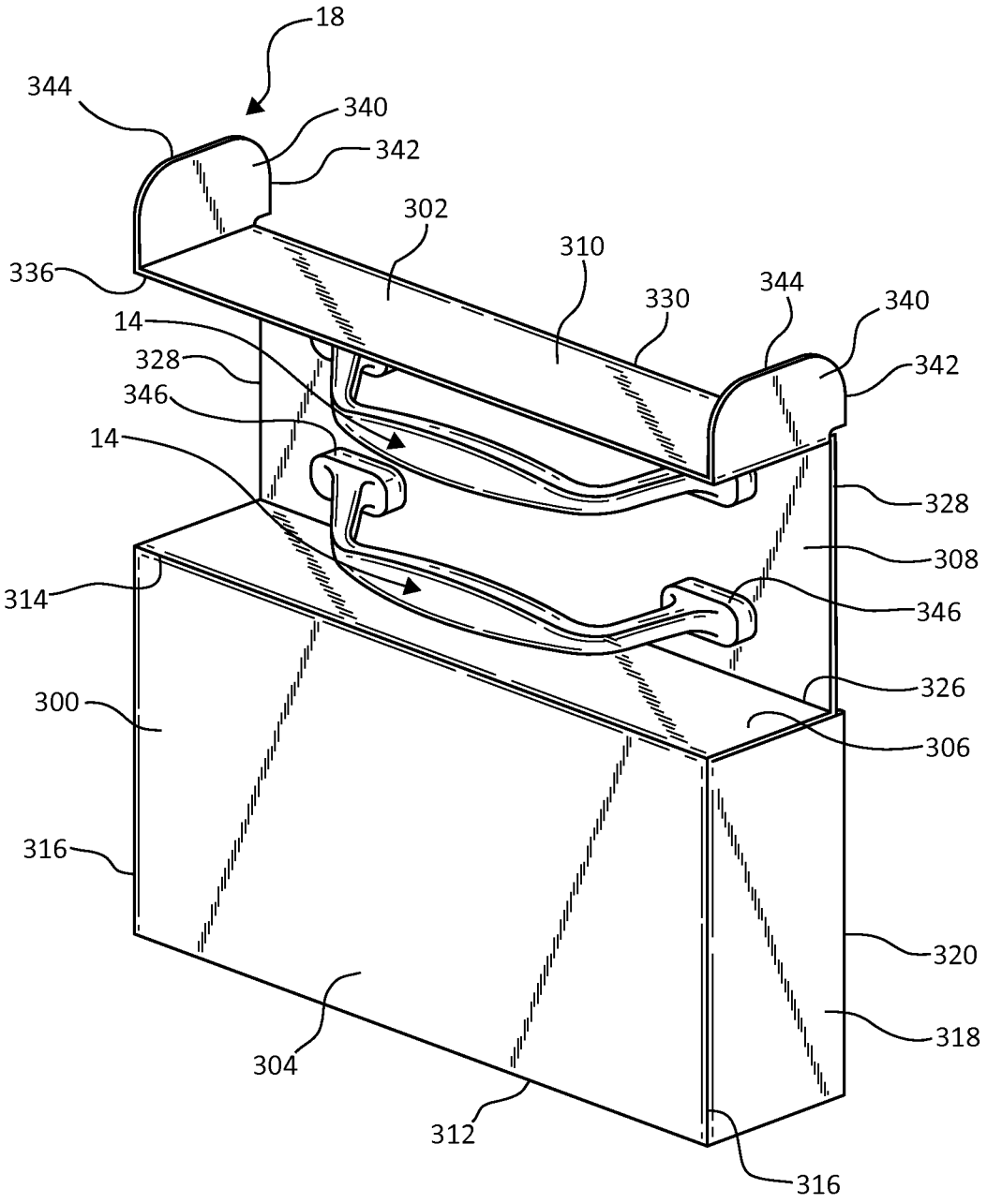
FIG. 11 is a front perspective view illustration of the insert blank folded for use along with products of the packaged product assembly of FIG. 1, accordingly to one embodiment of the present invention.

Referring to FIGS. 10 and 11, insert 18 is formed of a single sheet of a substantially planar material such as paperboard, cardboard, etc. to define an exterior surface 300 and an interior surface 302. In one embodiment, insert 18 includes an interior front panel 304, a lower chamber panel 306, a rear chamber panel 308, and an upper chamber panel 310. For example, interior front panel 304, lower chamber panel 306, rear chamber panel 308 and upper chamber panel 310 extend in series from a bottom free edge 312 of insert 18 to a top free edge 336 of insert 18. For instance, interior front panel 304 is substantially rectangular in shape and longitudinally extends from bottom free edge 312 to a first insert lateral fold line 314, which, in one example, extends substantially parallel to bottom free edge 312.

Laterally, interior front panel 304 extends between a opposing lateral fold line 316, which each have a height, that is, longitudinal dimension substantially equal to interior front panel 304. Insert 18 further includes two bottom side panels 318 each extending from a different lateral fold line 316 away from interior front panel 304 to a free edge 320. For example, a width of each bottom side panel 318, which is defined between respective ones of lateral fold lines 316 and free edges 320, is less than a width of second sidewall 42 of blank 30. Each free edge 320 is substantially parallel to lateral fold lines 316 and has a height substantially equal to a height of interior front panel 304, according to one embodiment. Each bottom side panel 318 terminates opposite bottom free edge 312 in a lateral free edge 322 that, in one example, is substantially collinear with first insert lateral fold line 314.

Lower chamber panel 306 extends from first insert lateral fold line 314 to a second insert lateral fold line 326 and between longitudinal side edges 328 on either side of lower chamber panel 306. In one example, longitudinal side edges 328 each extends substantially collinearly with a different one of lateral fold lines 316. Rear chamber panel 308 has a width substantially equal to lower chamber panel 306, and like lower chamber panel 306, extends laterally between longitudinal side edges 328. More specifically, in one example, rear chamber panel 308 extends from second insert lateral fold line 326 to a third insert lateral fold line 330. In one example, the height of rear chamber panel 308, that is a distance between insert lateral fold lines 326 to 330, is substantially equal to a distance between lateral window cuts 70. Rear chamber panel 308 defines a plurality of openings or apertures 332 positioned to receive one or more of the plurality of products 14 in any suitable manner, as will be further described below.

Upper chamber panel 310 extends from third inset lateral fold line 330 to a top free edge 336 and between opposing insert top longitudinal fold lines 338. In one example, insert top longitudinal fold lines 338 are each substantially collinear with a different one of longitudinal side edges 328. Insert 18 includes two topside panels 340, which each laterally extends from a different one of insert top longitudinal fold lines 338 to an opposite side edge 344. Each of the two topside panels 340 extends from top free edge 336 to insert side panel lower edge 342. In one embodiment, at least a portion of insert side panel lower edge 342 is substantially coplanar with third inset lateral fold line 330.

Referring to FIG. 11, products 14 are coupled to rear chamber panel 308. For example, where products 14 are cabinet handles having two opposing ends 346, a screw or other coupling device (not shown) is thread from interior surface 302 through a corresponding one of apertures 332 and into one of opposing ends 346 of one of the products 14. In one example, the coupling device is also useful for mounting the cabinet handle or other product 14 to a cabinet (not shown) or other end usage support. In other example, the coupling device is not useful for mounting product 14 to a cabinet. In one embodiment, the number of products 14 is less than the total number of products 14 offered with packaged product 10. For example, one or two sample ones of products 14 are mounted to rear chamber panel 308. In one embodiment, neither of the sample ones of products 14 extend beyond the footprint of rear chamber panel 308.

Once sample products 14 are mounted to rear chamber panel 308, insert 18 is folded for insertion into box 16. For example, insert 18 is folded forwardly about insert lateral fold lines 330 and 326 relative to rear chamber panel 308 such that lower chamber panel 306 and upper chamber panel 310 extend in substantially parallel planes. In one embodiment, interior front panel 304 is folded downwardly relative to lower chamber panel 306, about first insert lateral fold line 314, to extend substantially parallel with rear chamber panel 308 and/or substantially perpendicularly to lower chamber panel 306.

The two bottom side panels 318 are folded rearwardly relative to interior front panel 304 about lateral fold lines 316 until the bottom side panels 318 are located substantially perpendicularly relative to interior front panel 304 and/or lower chamber panel 306. Each of the top two side panels 340 is folded upwardly relative to upper chamber panel 310, for example, to extend in a plane substantially parallel to bottom side panels 318 and/or substantially perpendicularly relative to each of upper chamber panel 310, rear chamber panel 308, and lower chamber panel 306. When so folded, opposite side edges 344 face in a direction opposite to the direction faced by bottom free edge 312. When folded, insert 18 has an overall height measured between one of side edges 344 and bottom free edge 312 that is at least slightly less than an overall height of a compartment 202 (FIG. 8) of box 16. Folded insert 18 is ready to be placed in box 16.

In one embodiment, blank 30 is folded into box 16 prior to placing insert 18 therein, as illustrated with reference to FIGS. 8 and 9. For example, blank 30 is folded inwardly about each of first, second, third, and fourth longitudinal fold lines 50, 52, 54, and 56 until first side wall 40 is positioned in a plane substantially perpendicularly to rear wall 38, front wall 36 is positioned in a plane substantially perpendicularly to first side wall 40, second side wall 42 is positioned in a plane substantially perpendicularly to front wall 36, and coupling tab 64 is positioned in a plane substantially perpendicularly to second side wall 42. When so folded, box 16 defines compartment 202 between front wall 36, rear wall 38, first sidewall 40, and second sidewall 42. Coupling tab 64 fits inside compartment 202 collectively created by rear wall 38, front wall 36, first side wall 40, and second side wall 42, more particularly, along free edge 48 and adjacent a portion of interior surface 30 formed by rear wall 38, in one example. Adhesive 66 or other coupling agent is used to secure coupling tab 64 to rear wall 38 to box 16 in a configuration that defines compartment 202 therein. Once compartment 202 is defined, insert 18 is slid into box 16 either from a top or bottom opening thereof, for example, as generally illustrated in FIG. 8.

Figure 12:
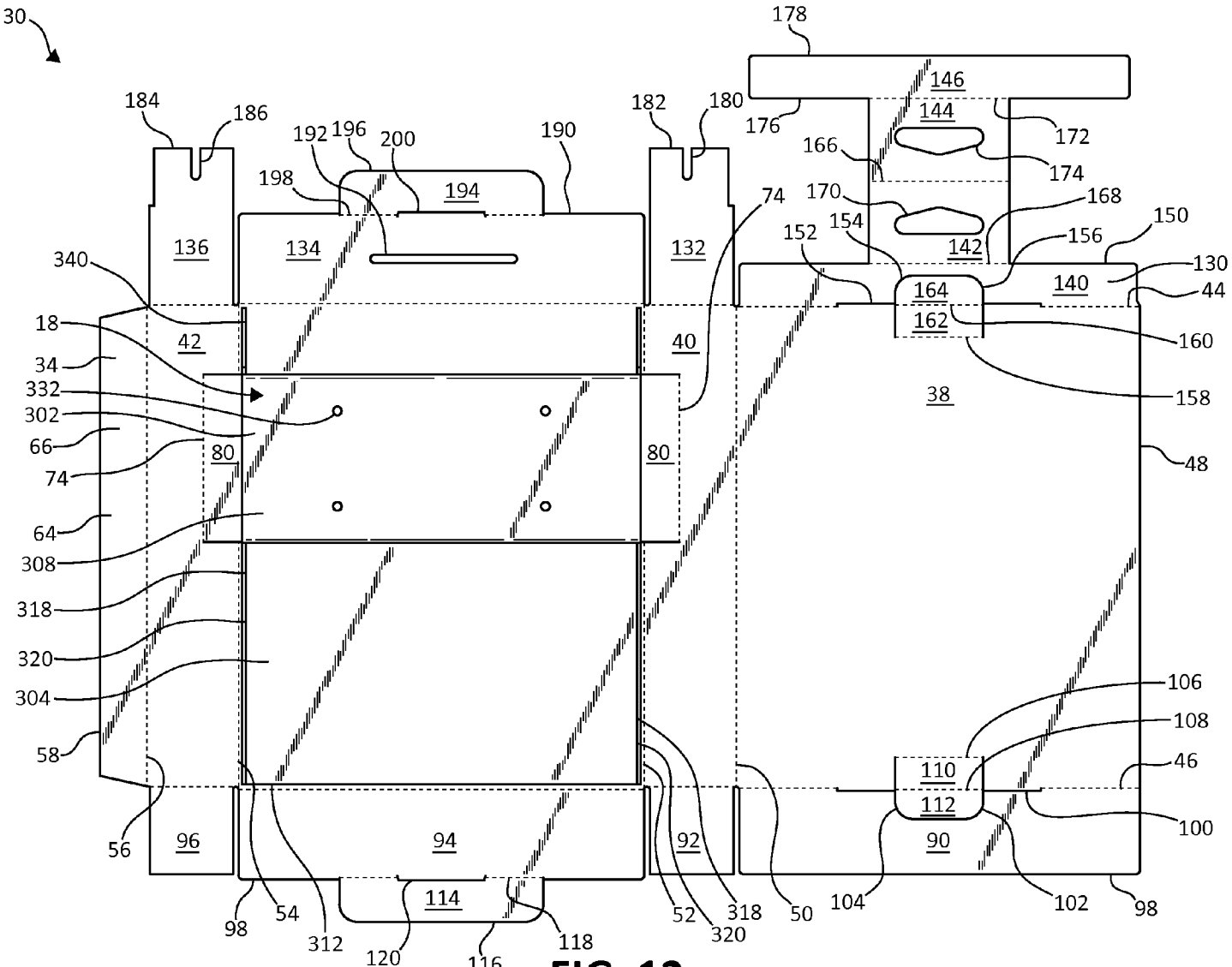
FIG. 12 is a rear view illustration of the unfolded primary blank of FIG. 9, accordingly to one embodiment of the present invention.

In another embodiment, insert 18 is placed relative to blank 30, and then blank 30 is folded around insert 18 as illustrated in FIG. 12. In this example, insert 18 is placed face down, that is, frontmost surfaces are placed down onto front wall 36 of blank 30, more particularly, to a portion of interior surface 34 formed by front wall 36. When so positioned, insert 18 lies substantially entirely within the footprint of front wall 36 and in a manner aligning rear chamber panel 308 with the opening defined between lateral window cuts 70. In one example, top and bottom chamber panels 306 and 310 each are positioned substantially coplanarly with an edge of blank 30 created by opposing lateral window cuts 70 (see, e.g., FIGS. 13 and 15).

Blank 30 is subsequently folded around insert 18, for example, by folding blank 30 inwardly about each of first, second, third, and fourth longitudinal fold lines 50, 52, 54, and 56 until first side wall 40 is positioned in a plane substantially perpendicularly to rear wall 38, front wall 36 is positioned in a plane substantially perpendicularly to first side wall 40, second side wall 42 is positioned in a plane substantially perpendicularly to front wall 36, and coupling tab 64 is positioned in a plane substantially perpendicularly to second side wall 42. When so folded, box 16 defines compartment 202 between front wall 36, rear wall 38, first sidewall 40, and second sidewall 42. Coupling tab 64 fits inside compartment 202 collectively created by rear wall 38, front wall 36, first side wall 40, and second side wall 42 and adjacent a portion of interior surface 30 formed by rear wall 38, more particularly, in one example, along free edge 48. Adhesive 66 or other coupling agent is used to secure coupling tab 64 to rear wall 38 to box 16 in a configuration that defines compartment 202 therein.

When box 16 is so folded, interior front panel 304 is placed adjacent to, and in one example, in a manner abutting, a portion of interior surface 34 defined by front wall 36 of box 16, and the two bottom side panels 318 and the two topside panels 340 each are placed adjacent to and in one example, in a manner abutting, a portion of interior surface 34 defined by one of the first and second sidewalls 40 and 42. The height of interior front panel 304 is substantially equal to a distance the lower one of lateral window cuts 70 is spaced from bottom fold line 46 to maintain lower chamber panel 306 substantially even with the lower one of lateral window cuts 70. The height of each of the two topside panels 340 is substantially equal to a distance the upper one of lateral window cuts 70 is spaced from top fold line 46 to maintain upper chamber panel 310 substantially even with the upper one of lateral window cuts 70. In this manner, open chamber 22 is defined between upper chamber panel 310 and lower chamber panel 306 and between first sidewall 40 and second sidewall 42.

In one example, in which blank 30 includes chamber sidewalls 80 and side coupling tabs 82, prior to sliding insert 18 into chamber 22 or prior to folding blank 30 around inset 18, each chamber sidewall 80 is rotated rearwardly about a corresponding one of longitudinal fold lines 74 to extend substantially parallel with and abut a portion of interior surface 34 defined by a corresponding one of first side wall 40 and second side wall 42. Each of side coupling tabs 82 is folded about a respective one of second window longitudinal fold lines 76 to extend substantially perpendicularly relative to chamber sidewalls 80 in a direction extending toward the other one of side coupling tabs 82.

With chamber sidewalls 80 and side coupling tabs 82 folded as described above, when insert 18 is slid into chamber 220 or when blank 30 is folded around insert 18, chamber sidewalls 80 face toward open chamber 22 and toward one another. Side coupling tabs 82 are interposed between rear chamber panel 308 of insert 18 and rear wall 38 of box 16. When so assembled, open chamber 22 is closed at the rear, top, and bottom, and is open to the front. In one example, open chamber 22 is at least partially open to the sides so that consumers can visually see the sample products 14 from various vantage points. In one embodiment, open chamber 22 is at least partially open to each of side panels 40 and 42 due to extension of lateral window cuts 70 into an interior thereof, more particularly, beyond respective ones of second and third longitudinal fold lines 52 and 54.

In one embodiment, the sample ones of products 14 that are coupled with rear chamber panel 310 are maintained within open chamber 22 such that the sample ones of products 14 are both visible and tactically accessible to potential consumers via open chamber 22. In one example, any coupling members used to couple the sample ones of product 14 to rear chamber panel 310 are hidden from view via the sample ones of product 14, rear chamber wall 310, and rear wall 38 of box 16. At this stage of assembly, packaged product 10 is in the state illustrated in FIG. 13, in one example.

Figure 14:
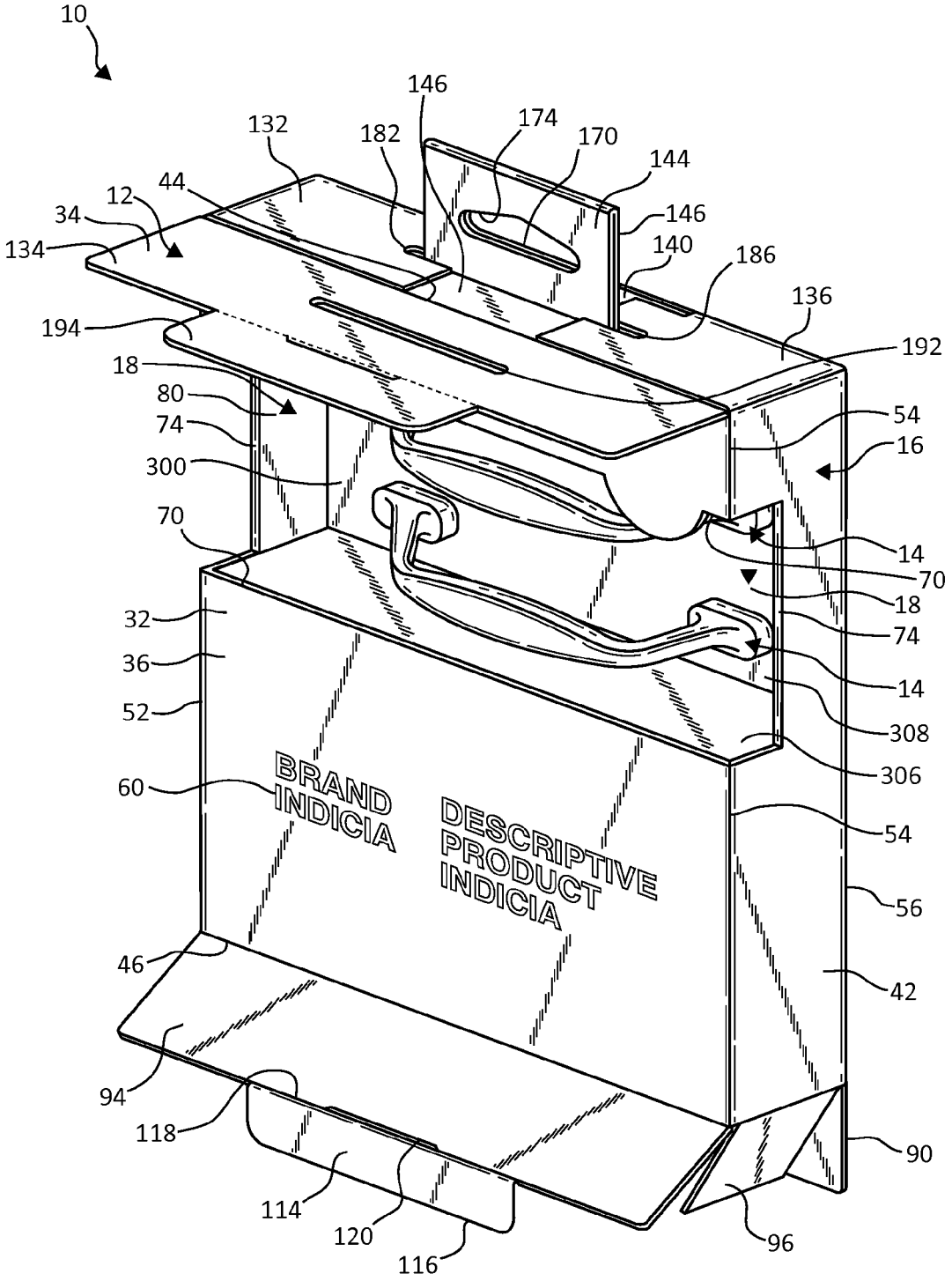
FIG. 14 is a front perspective view illustration of the partially assembled packaged product of FIG. 13 additionally folded for further assembly, according to one embodiment of the present invention.

Referring to FIGS. 9, 13, and FIG. 14, which shows the next folding steps, assembly of a top of package 12 includes folding of internal top wall 130 into place relative to a remainder of box 16. More specifically, internal top wall 130 is folded forwardly about top fold line 44 to extend substantially perpendicularly to each of front wall 36, rear wall 38, first sidewall 40, and second sidewall 42 as shown in FIG. 14. When internal top wall 130 is so positioned, due to the presence of slit 152, a top facing elongated opening (not shown) is formed and faces upwardly. Rear hang tab portion 142 is folded upwardly relative to rear top wall portion 40 about tab fold line 168 to extend substantially vertically and/or substantially parallel with rear wall 38 of box 16. Front hang tab portion 144 is folded downwardly over and to abut rear hang tab portion 142 about hang tab top fold line 166. In one example, rear hang tab portion 142 and front hang tab portion 144 collectively define a two-ply hang tab for receiving a support rod or structure (not shown) in a retail or other suitable display. When so folded, aperture 170 of rear hang tab portion 142 aligns with aperture 174 of front hang tab portion 144 such than any support extends through both apertures 170 and 174. Front top wall portion 146 is folded forwardly about front hang tab portion 144 to extend substantially parallel with top chamber panel 306. In one example, rear top wall portion 140 and front top wall portion 134 are at least partially maintained in their location due to interaction at either end thereof with one of the two topside panels 340 of insert 18.

Figure 1:
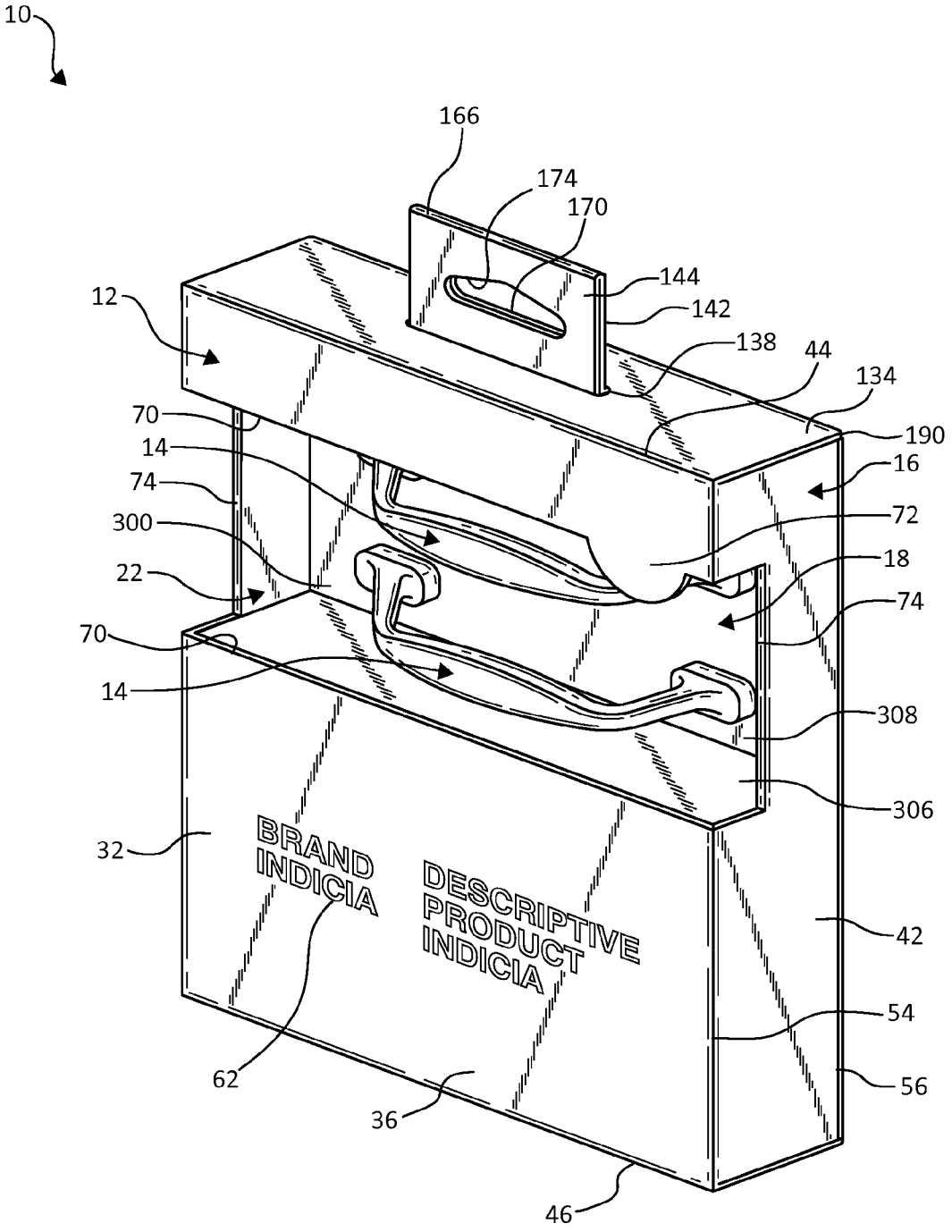
FIG. 1 is a front perspective view illustration of a packaged product, according to one embodiment of the present invention.
Figure 2:
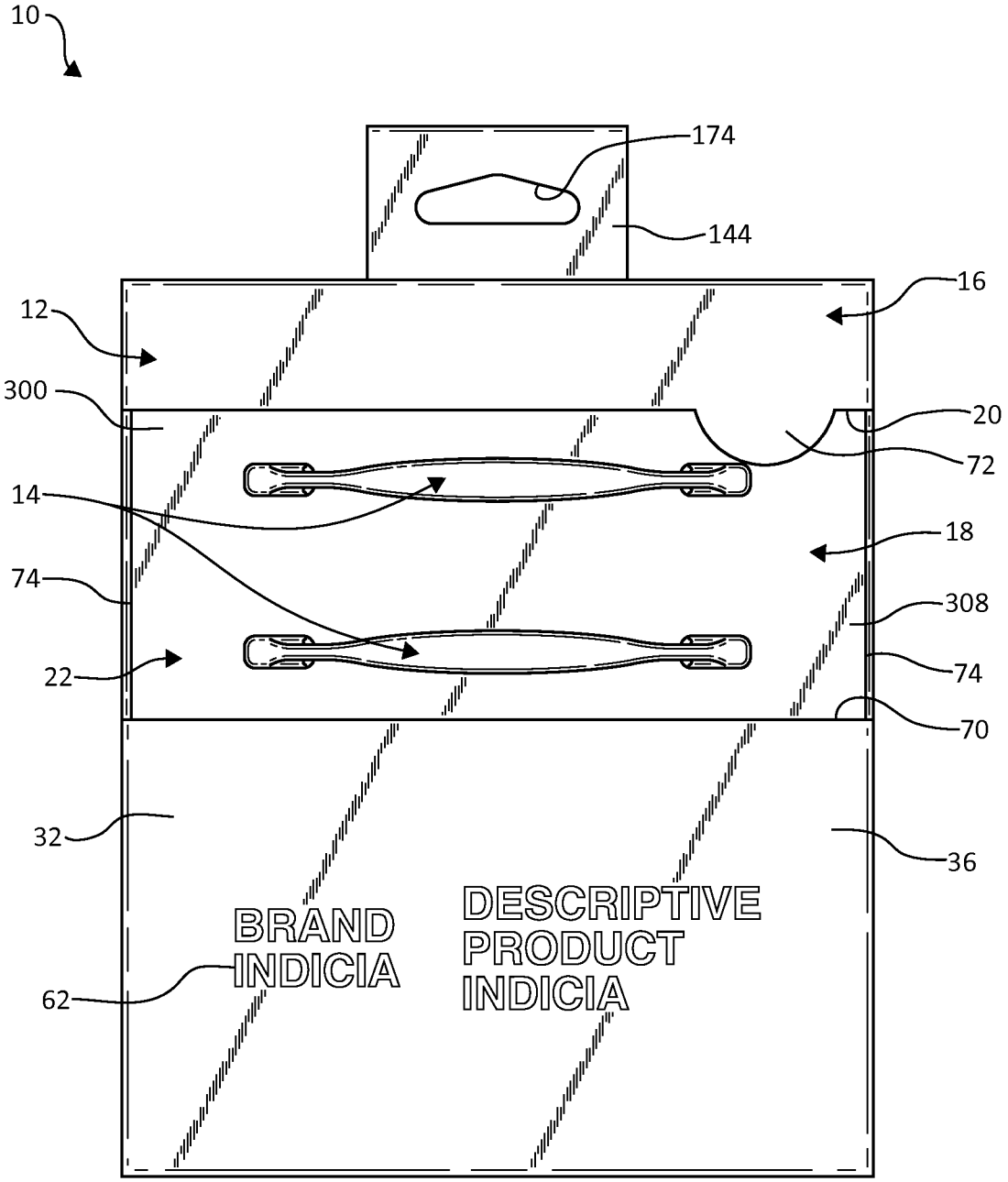
FIG. 2 is a front view illustration of the packaged product of FIG. 1, according to one embodiment of the present invention.
Figure 3:
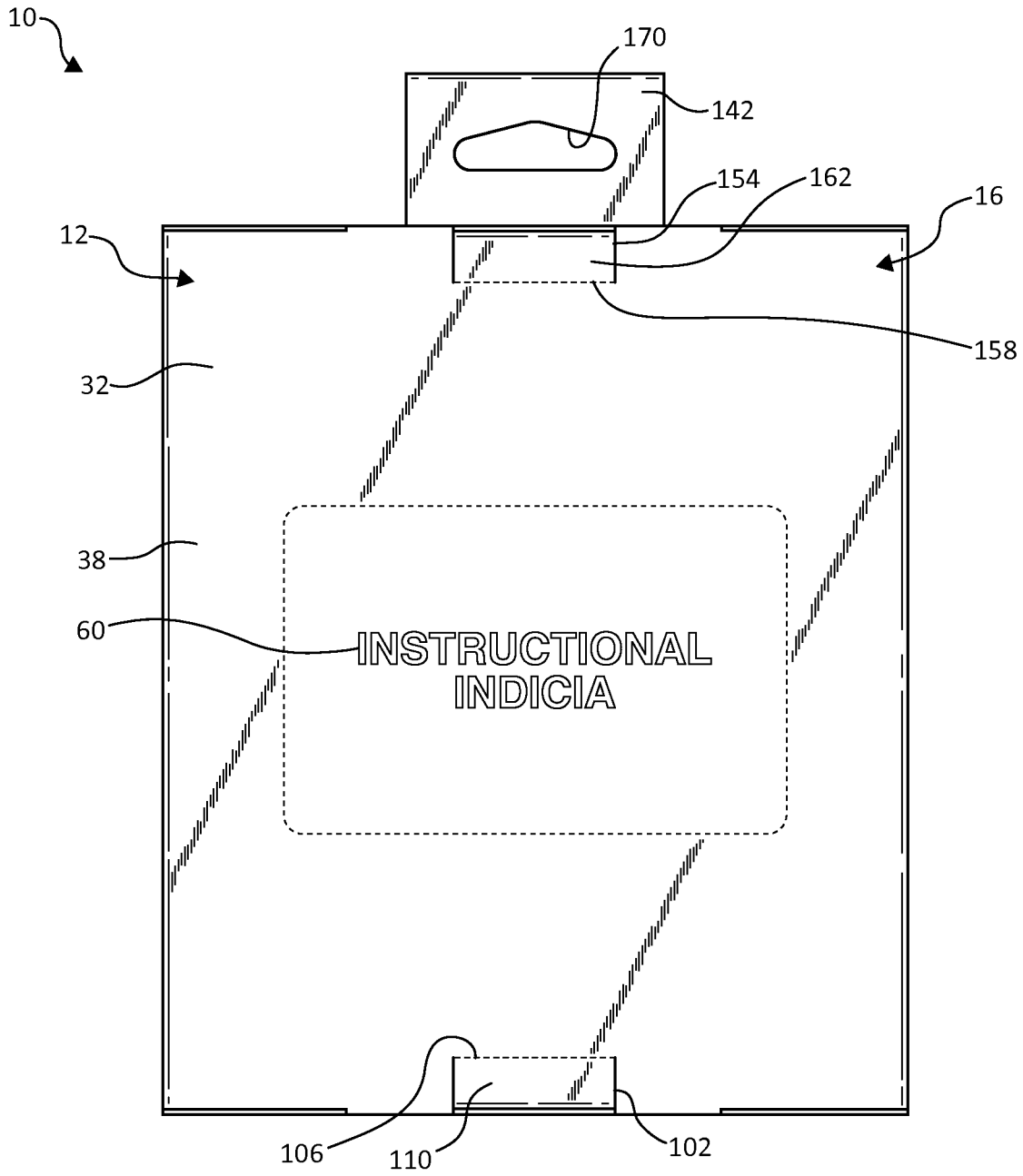
FIG. 3 is a rear view illustration of the packaged product of FIG. 1, according to one embodiment of the present invention.
Figure 4:
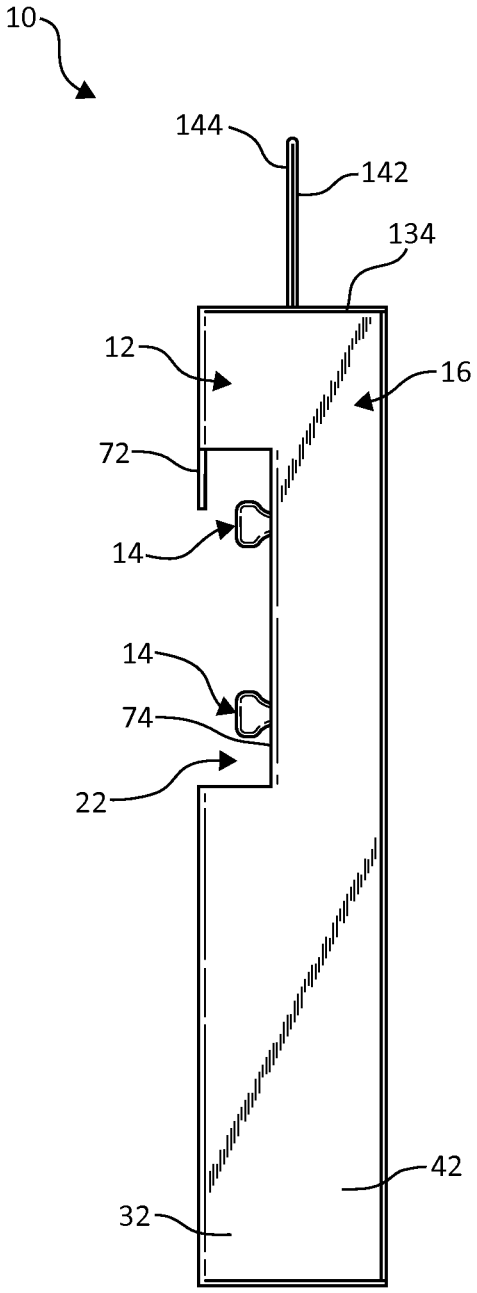
FIG. 4 is a right side view illustration of the packaged product of FIG. 1, according to one embodiment of the present invention.
Figure 5:
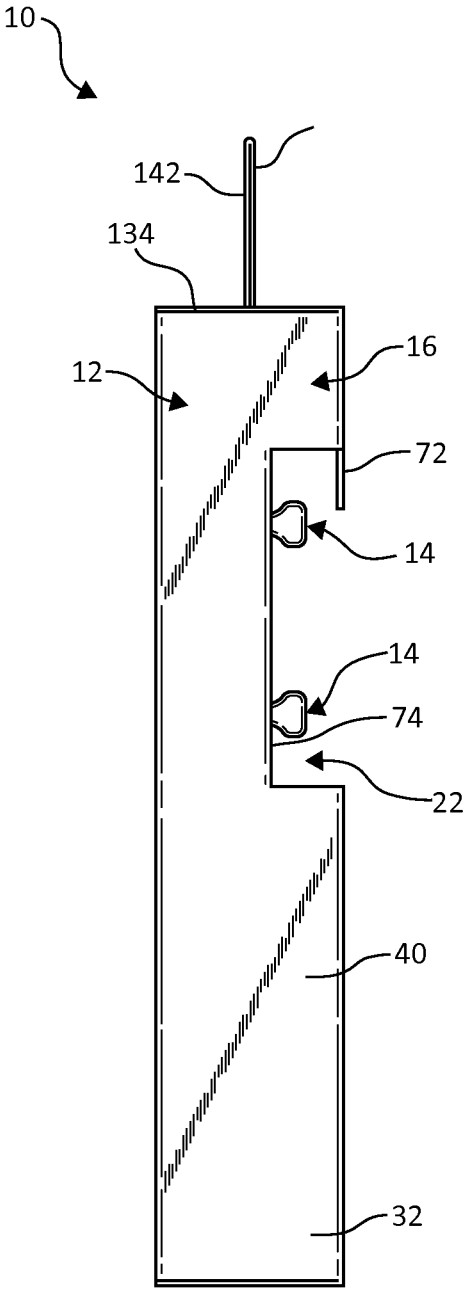
FIG. 5 is a left side view illustration of the packaged product of FIG. 1, according to one embodiment of the present invention.
Figure 6:
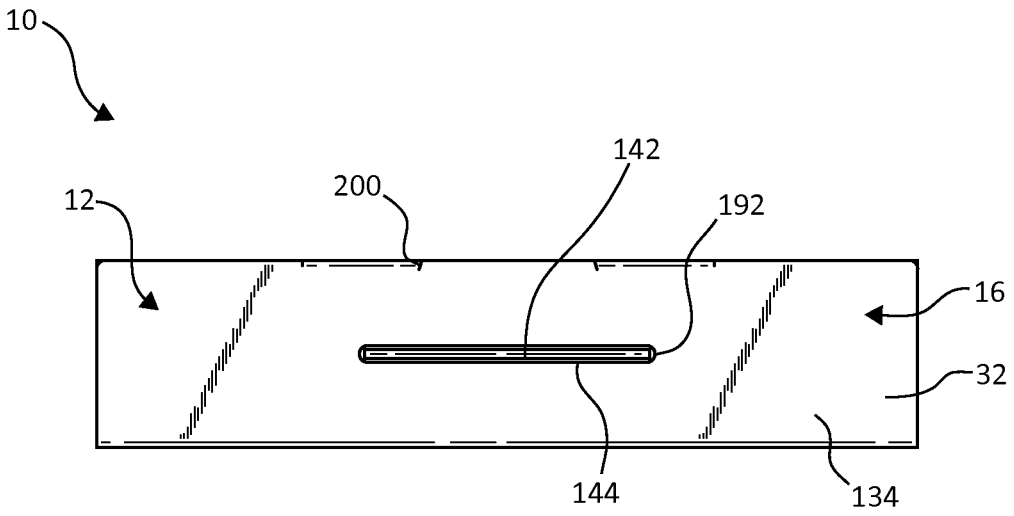
FIG. 6 is a top view illustration of the packaged product of FIG. 1, according to one embodiment of the present invention.
Figure 7:
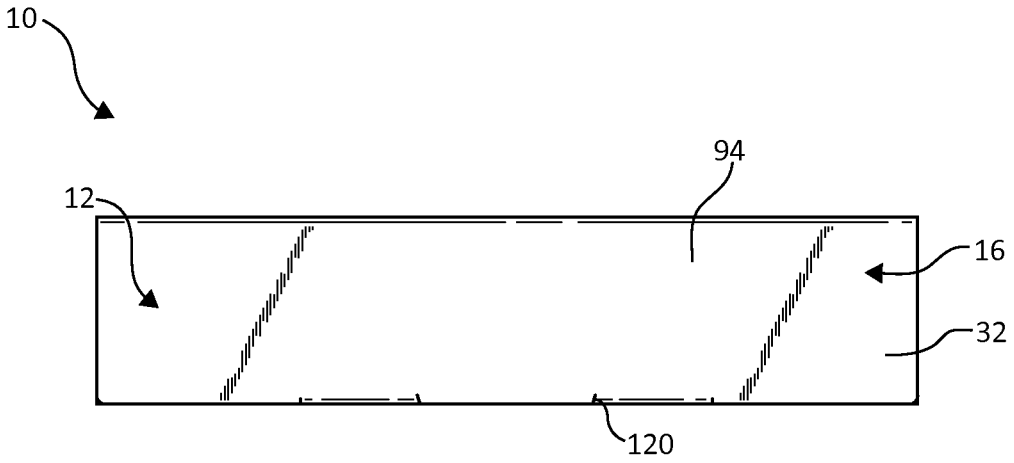
FIG. 7 is a bottom view illustration of the packaged product of FIG. 1, according to one embodiment of the present invention.
Figure 15:
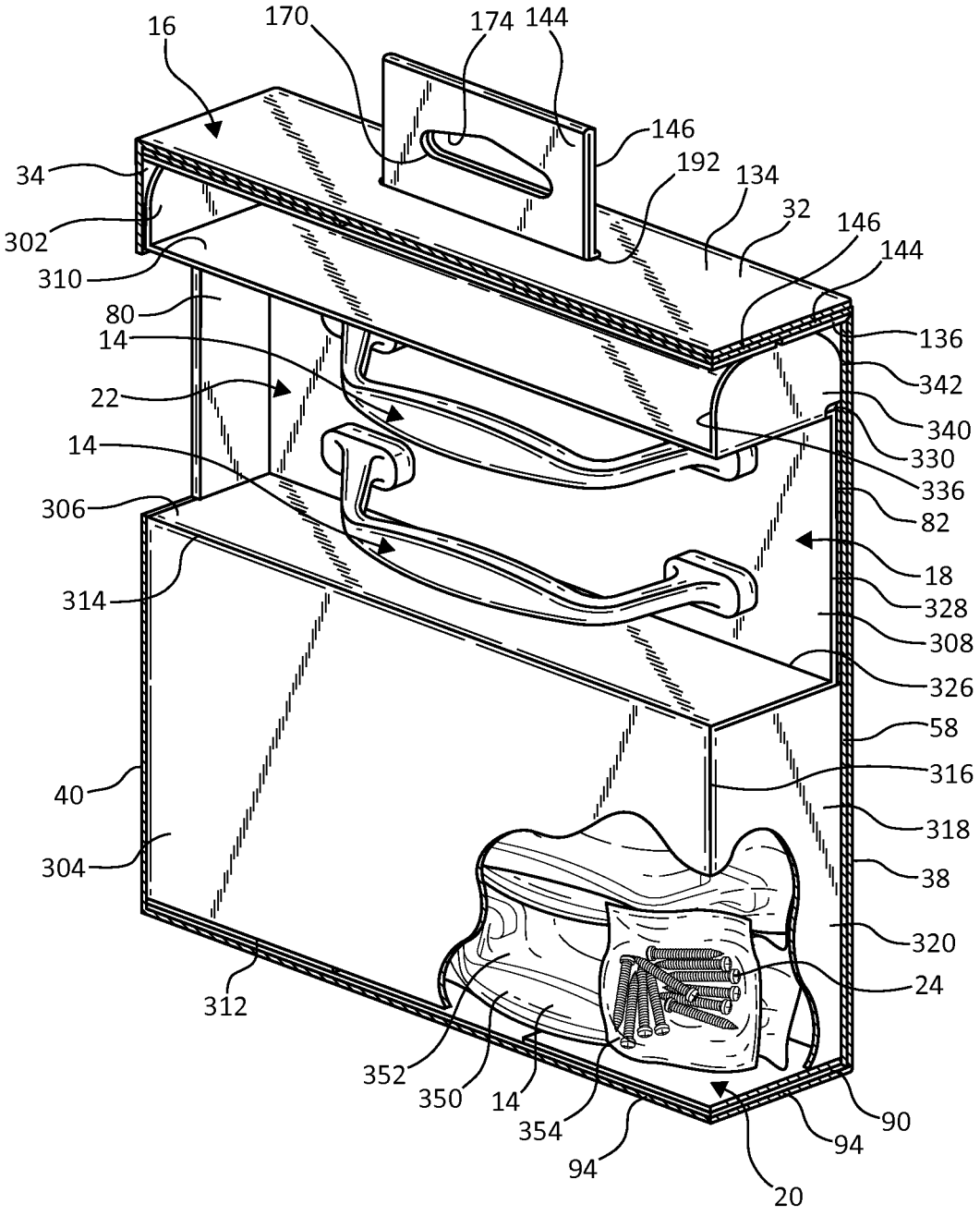
FIG. 15 is a front perspective view illustration of the assembled packaged product of FIG. 1 with the front and right side panels of the primary insert and a portion of a front panel of the insert blank removed to show details of the assembly of the packaged product, according to one embodiment of the present invention.

First side top wall 132 and second side top wall 136 are each folded about top fold line 44 toward each other to extend substantially perpendicularly to each of first and second sidewalls 40 and 42 and to lie over and abut each of rear top wall portion 140 and front top wall portion 142. In this position, in one example, each respective cutout 186 and 182 receives a different side of each of the rear and front hang tab portions 142 and 144 providing additional structural integrity to the dual layer hang tab. Exterior top wall 134 is folded rearwardly relative to front wall 36 about top fold line 44 such that the hang tab, that is both front hang tab portion 144 and rear hang tab portion 142, extend through elongated opening 192 and exterior top wall 134 extends fully over first and second side top walls 132 and 134. Lateral flange 194 is folded downwardly about lateral flange fold line 198 and push through the elongated opening adjacent slit 152. In one embodiment, folding lateral flange 194 creates an elongated opening adjacent slit 200. Second portion 164 of coupling tab 154 is forwardly folded about interior tab fold line 160 and slid into the elongated opening formed adjacent slit 200 to effectively lock or hold the top portion of box 16 closed with the hang tab extending above a remainder of box 16 as shown in FIG. 1 and FIG. 15, for example.

Either before or after the top of box 16 is folded and secured, additional products 16 are placed in the closed chamber 20, which is formed between rear wall 38 of box 16 and interior front panel 304 and bottom side panels 318 of insert 18. More specifically, as shown in FIGS. 8 and 15, additional products 14, that is, in addition to the sample ones of products 14 secured in open chamber 22, are provided in a wrap or bag 352 to formed bagged products 350, in one embodiment. Bagged products 250, are placed in closed chamber 20, for example, along with coupling members 24 in one or more bags 354, such as screws or other fasteners 54 to facilitate end use of products 14. While bagged products 350 are completely enclosed in closed chamber 20, in one example, consumer are still able to inspect the merchandise via the sample ones of products 14, which are substantially identical to products 14 in the one or more bags 354 and are exposed via open chamber 22.

Once bagged products 350 are in place in closed chamber 20, bottom of box 16 is closed. More specifically, in one embodiment, first side bottom wall 92 and second side bottom wall 96 are each folded inwardly toward each other about bottom fold line 46 to extend substantially perpendicular to each of front wall 36, rear wall 38, and first and second side walls 40 and 42. Interior bottom wall 90 is folded forwardly about bottom fold line 46 to extend over and, in one example, to abut first side bottom wall 92 and second side bottom wall 94. When interior bottom wall 90 is folded an elongated opening (not shown) is formed adjacent to and due to slit 100. Exterior bottom wall 94 is folded rearwardly about bottom fold line 96 to extend over an, in one example, abut interior bottom wall 90. Bottom lateral flange 114 is fold downwardly about lateral flange fold line 118 to extend into the elongated slot formed adjacent slit 100. Folding bottom lateral flange 114 about bottom fold line 46 defines an elongated slot adjacent slit 120. Second portion 112 of coupling tab 102 is folded about at least interior tab fold line 108 and is slid into the elongate slot adjacent slit 120 to selectively lock or maintain a bottom of box 16 in a closed position. As described herein, internal bottom wall 90, exterior bottom wall 94, and first side bottom wall 92, and/or second side bottom wall 96 collectively define a bottom of box 16. In one example, a sticker, label, etc. (not shown) is placed over a part of first portion 110 of coupling tab 102 and a part of exterior bottom wall 94 to further secure a bottom of box 16 in a closed position.

Although the invention has been described with respect to particular embodiments, such embodiments are meant for the purposes of illustrating examples only and should not be considered to limit the invention or the application and uses of the invention. Various alternatives, modifications, and changes will be apparent to those of ordinary skill in the art upon reading this application. Furthermore, there is no intention to be bound by any theory presented in the preceding background of the invention or the above detailed description.

What is claimed is:

1. A package comprising:

a box including a front wall and defining a compartment therein, the front wall defining an open window between a top window edge and a bottom window edge of the front wall, wherein the open window provides direct access to the compartment;

an insert maintained within the compartment, the insert defining a top chamber panel adjacent the top window edge, a rear chamber panel, and a bottom chamber panel adjacent the bottom window edge, wherein:

the insert is maintained within the compartment such that the bottom chamber panel divides the compartment into at least an open chamber and a closed chamber, the open chamber is defined immediately adjacent the open window between the top chamber panel and the bottom chamber panel, and the closed chamber is defined on a side of the bottom chamber panel opposite the open chamber.

2. The package of claim 1, wherein at least the top chamber panel and the bottom chamber panel maintain the open chamber substantially entirely separate from a remainder of the compartment.

3. The package of claim 1, wherein the insert is formed of a single piece of a planar material folded to define each of the top chamber panel, the rear chamber panel, and the bottom chamber panel.

4. The package of claim 3, wherein:

the box defines a first sidewall and a second sidewall opposite the first sidewall, each of the first sidewall and the second sidewall extends rearwardly from an opposite edge of the front wall and form an exterior portion of the box, each of the top chamber panel, the rear chamber panel, and the bottom chamber panel extends between the first sidewall and the second sidewall of the box and abuts each of the first sidewall and the second sidewall of the box.

5. The package of claim 3, wherein:

the box further includes:

a rear wall, opposing sidewalls, a top wall, and a bottom wall, the front wall, the rear wall, the opposing sidewalls, the top wall, and the bottom wall of the box collectively enclose the compartment other than the window, and the box is formed of a single piece of planar material folded to define the front wall, the rear wall, the opposing sidewalls, the top wall, and the bottom wall.

6. The package of claim 5, wherein the box includes a hang tab extending upwardly from a remainder of the box configured to hang from a support structure for retail display.

7. The package of claim 1, wherein the insert further defines an interior front panel extending from a front edge of the bottom chamber panel to a bottom of the compartment, the interior front panel at least partially maintains the bottom chamber panel longitudinally positioned within the compartment to be substantially aligned with the bottom window edge.

8. The package of claim 7, wherein the insert further defines two side panels each extending from either side edge of the interior front panel to at least partially maintain the bottom chamber panel in position within the compartment to be substantially aligned with the bottom window edge.

9. The package of claim 7, wherein the insert further defines at least one side top panel extending upwardly from the top chamber panel to at least partially maintain the top chamber panel in position within the compartment spaced from a top of the box to be substantially aligned with the top window edge.

10. The package of claim 9, wherein:

the at least one side top panel interfaces with an interior surface of the top of the box, and the interior front panel interfaces with an interior surface of a bottom of the box to laterally maintain the top chamber panel and the bottom chamber panel of the insert aligned with the window.

11. The package of claim 9, wherein the at least one side top panel is two side top panels positioned to each extend upwardly from a different one of opposing edges of the top chamber panel.

12. The package of claim 1, wherein the opposing edges of the top chamber panel each extend substantially perpendicularly to the top window edge.

13. The package of claim 1, wherein the box defines a rear wall opposite the front wall, and the rear chamber panel abuts the rear wall and extends substantially parallel to each of the rear wall and the front wall of the box.

14. The package of claim 1, wherein:

the top chamber panel is positioned to be substantially planar with the top window edge, and the bottom chamber panel is positioned to be substantially planar with the bottom window edge.

15. The package of claim 1, in combination with at least one sample product and additional products, wherein:

the at least one sample product is secured to the rear panel of the insert and positioned within the open chamber, the additional products are enclosed within the closed chamber, and the sample product and the additional products are substantially identical to one another.

16. The package of claim 1, in combination with at least one sample product and additional products, wherein:

the at least one sample product is secured to the rear panel of the insert and positioned within the open chamber, the additional products are enclosed within the closed chamber, the sample product and the additional products are substantially identical to one another, and the sample products are visually and tactilely accessible via the window for inspection by a consumer considering purchase of the at least one sample product and the additional products.

17. A package comprising:

a primary member including:

a front wall, a rear wall, and two opposing sidewalls each extending between the front wall and the rear wall, wherein a compartment is defined between the front wall, the rear wall, and two opposing sidewalls, and the front wall includes an opening therein; and a secondary member including:

a top chamber panel extending from the front wall to the rear wall just above the opening, a bottom chamber panel extending from the front wall to the rear wall just below the opening to define an open chamber between the top chamber panel, the bottom chamber panel, the rear wall, and the two opposing side walls, and at least one side panel extending from one of the bottom chamber panel and the top chamber panel away from the other of the bottom chamber panel and the top chamber panel to longitudinally position the insert within the compartment in a manner spaced from each of a top and a bottom of the primary member and aligning the top chamber panel and the bottom chamber panel with opposing edges of the opening.

18. The package of claim 17, wherein each of the primary member and the secondary member are formed of a single piece of planar material.

* * * * *